US010060235B2

(12) United States Patent
Damiano et al.

(10) Patent No.: US 10,060,235 B2
(45) Date of Patent: Aug. 28, 2018

(54) PLUNGER LIFT SYSTEMS AND METHODS

(71) Applicant: EOG Resources, Inc., Fort Worth, TX (US)

(72) Inventors: Joseph R. Damiano, Aledo, TX (US); James A. Keeton, Fort Worth, TX (US)

(73) Assignee: EOG RESOURCES, INC., Fort Worth, TX (US)

( * ) Notice: Subject to any disclaimer, the term of this patent is extended or adjusted under 35 U.S.C. 154(b) by 142 days.

(21) Appl. No.: 15/245,567

(22) Filed: Aug. 24, 2016

(65) Prior Publication Data

US 2017/0058651 A1 Mar. 2, 2017

Related U.S. Application Data

(60) Provisional application No. 62/209,487, filed on Aug. 25, 2015.

(51) Int. Cl.

| | |
|---|---|
| ***E21B 33/12*** | (2006.01) |
| ***E21B 43/12*** | (2006.01) |
| ***F04B 47/12*** | (2006.01) |

(52) U.S. Cl.

CPC ..... *E21B 43/121* (2013.01); *F04B 47/12* (2013.01)

(58) Field of Classification Search

CPC ..... E21B 43/121; F04B 31/00; F04B 47/12
See application file for complete search history.

(56) References Cited

U.S. PATENT DOCUMENTS

| | | | | |
|---|---|---|---|---|
| 2,001,012 | A * | 5/1935 | Burgher | E21B 37/04 417/60 |
| 2,697,823 | A | 12/1954 | Undy | |
| 2,788,521 | A | 4/1957 | Undy | |
| 2,803,425 | A | 8/1957 | Little | |
| 2,886,703 | A | 5/1959 | Undy | |
| 4,235,288 | A | 11/1980 | Watson | |
| 4,291,761 | A | 9/1981 | Watson | |
| 4,383,552 | A | 5/1983 | Baker | |

(Continued)

FOREIGN PATENT DOCUMENTS

CA 2705086 A1 * 11/2010 ..... E21B 43/121

*Primary Examiner* — David J Bagnell
*Assistant Examiner* — Dany E Akakpo
(74) *Attorney, Agent, or Firm* — Conley Rose, P.C.

(57) ABSTRACT

A plunger piston assembly for a plunger lift system used to remove fluids from a subterranean wellbore includes a sealing sleeve having a central axis, an upper end, a lower end, and a throughbore extending axially from the upper end of the sealing sleeve to the lower end of the sealing sleeve. The throughbore of the sealing sleeve defines a receptacle extending axially from the lower end of the sealing sleeve. In addition, the plunger piston assembly includes an intermediate sleeve having a central axis, an upper end, a lower end, and a throughbore extending axially from the upper end of the intermediate sleeve to the lower end of the intermediate sleeve. The throughbore of the intermediate sleeve defines a receptacle extending axially from the lower end of the intermediate sleeve. The upper end of the intermediate sleeve is configured to be removably seated in the receptacle of the sealing sleeve. Further, the plunger piston assembly includes a plug configured to be removably seated in the in the receptacle of the intermediate sleeve.

21 Claims, 18 Drawing Sheets

(56) References Cited

U.S. PATENT DOCUMENTS

| | | | |
|---|---|---|---|
| 4,989,671 | A | 2/1991 | Lamp |
| 5,868,554 | A | 2/1999 | Giacomino et al. |
| 6,148,923 | A | 11/2000 | Casey |
| 6,176,309 | B1 | 1/2001 | Bender |
| 6,209,637 | B1 | 4/2001 | Wells |
| 6,467,541 | B1 | 10/2002 | Wells |
| 6,719,060 | B1 | 4/2004 | Wells |
| 7,243,730 | B2 | 7/2007 | Casey |
| 7,290,602 | B2 | 11/2007 | Victor |
| 7,314,080 | B2 | 1/2008 | Giacomino |
| 7,328,748 | B2 | 2/2008 | Giacomino |
| 7,383,878 | B1 | 6/2008 | Victor |
| 7,395,865 | B2 | 7/2008 | Bender |
| 7,438,125 | B2 | 10/2008 | Victor |
| 7,513,301 | B2 | 4/2009 | Victor |
| 7,591,308 | B2 | 9/2009 | Bender |
| 7,597,143 | B2 | 10/2009 | Giacomino |
| 7,690,425 | B2 | 4/2010 | Giacomino |
| 7,748,448 | B2 | 7/2010 | Bender |
| 7,793,728 | B2 | 9/2010 | Bender |
| 7,878,251 | B2 | 2/2011 | Giacomino et al. |
| 7,954,545 | B2 | 6/2011 | Hearn et al. |
| 8,162,053 | B2 | 4/2012 | Green et al. |
| 8,201,629 | B2 | 6/2012 | Green |
| 8,485,263 | B2 | 7/2013 | Lembcke |
| 8,607,880 | B2 | 12/2013 | Smith et al. |
| 8,863,837 | B2 | 10/2014 | Bender |
| 8,869,902 | B2 | 10/2014 | Smith et al. |
| 9,068,443 | B2 | 6/2015 | Jefferies et al. |
| 9,109,424 | B2 | 8/2015 | Jefferies et al. |
| 9,121,269 | B2 | 9/2015 | Longfellow et al. |
| 2015/0300136 | A1 | 10/2015 | Jefferies et al. |
| 2016/0010436 | A1 | 1/2016 | Boyd |

* cited by examiner

PLUNGER LIFT SYSTEMS AND METHODS

CROSS-REFERENCE TO RELATED APPLICATIONS

This application claims benefit of U.S. provisional patent application Ser. No. 62/209,487 filed Aug. 25, 2015, and entitled "Plunger Lift Systems and Methods," which is hereby incorporated herein by reference in its entirety.

STATEMENT REGARDING FEDERALLY SPONSORED RESEARCH OR DEVELOPMENT

Not applicable.

BACKGROUND

The disclosure relates generally to plunger lift systems and methods for lifting liquids from subterranean boreholes. More particularly, the disclosure relates to plunger pistons for lifting liquids in a production string to the surface.

Subterranean formations that produce gas often produce liquids such as hydrocarbon condensates (e.g., relatively light gravity oil) and water from the reservoir. Such liquids can result from the migration of liquids from the surrounding reservoir into the bottom of the wellbore, or result from the migration of vapors from the surrounding reservoir into the wellbore, which subsequently condense and fall back to the bottom of the wellbore. More specifically, as the vapors enter the wellbore and travel up the wellbore, their temperatures drop below the respective dew points and they transition from vapor phase into liquid condensate.

In some wells that produce both gas and liquid, the formation gas pressure and volumetric flow rate are sufficient to lift the liquids to the surface. In such "strong" wells, the accumulation of liquids in the bottom of the wellbore generally does not inhibit gas production as the liquids are continuously lifted to the surface by the flow of the production gas. However, in wells where the gas does not provide sufficient energy to lift liquids out of the well (i.e., the formation gas pressure and volumetric flow rate are not sufficient to lift liquids to the surface), the liquids accumulate in the wellbore. In particular, as the life of a gas well matures, reservoir pressures that drive gas production to surface slowly decline, resulting in lower production. At some point, the production gas velocities drop below the "Critical Velocity" (CV), which is the minimum velocity required to carry a droplet of water to the surface. As time progresses these droplets accumulate in the bottom of the wellbore. If a sufficient volume of liquids accumulate in the bottom of the wellbore, the well may eventually become "loaded" as the hydrostatic head of liquid imposes a pressure on the production zone sufficient to restrict and/or prevent the flow of gas from the production zone, at which point the well is "killed" or "shuts itself in." As a result, it may become necessary to use artificial lift techniques to remove the accumulated liquid from the wellbore to restore and/or increase the flow of gas from the formation.

Plunger lift systems are one type of artificial lift technique that relies on a free piston that is dropped down the production string into the well. Often, the well is first shut-in at the wellhead to stop the upward flow of production fluids in the production string. The free piston is allowed to fall through the production string and any liquids therein to a bumper located at the lower end of the production string. The well is then opened at the wellhead, thereby allowing gas to flow into the production string below the piston. When the pressure below the piston, due to the influx of gas, is sufficient, the piston is pushed upward through the production string to the surface, thereby lifting the liquids and gases in the production string disposed above the piston to the surface. This process is generally repeated to continually remove liquids from the production string.

BRIEF SUMMARY OF THE DISCLOSURE

Embodiments of plunger piston assemblies for a plunger lift system used to remove fluids from a subterranean wellbore are disclosed here in. In one embodiment, the plunger piston assembly comprises a sealing sleeve having a central axis, an upper end, a lower end, and a throughbore extending axially from the upper end of the sealing sleeve to the lower end of the sealing sleeve. The throughbore of the sealing sleeve defines a receptacle extending axially from the lower end of the sealing sleeve. In addition, the plunger piston assembly includes an intermediate sleeve having a central axis, an upper end, a lower end, and a throughbore extending axially from the upper end of the intermediate sleeve to the lower end of the intermediate sleeve. The throughbore of the intermediate sleeve defines a receptacle extending axially from the lower end of the intermediate sleeve. The upper end of the intermediate sleeve is configured to be removably seated in the receptacle of the sealing sleeve. Further, the plunger piston assembly includes a plug configured to be removably seated in the in the receptacle of the intermediate sleeve.

Embodiment of plunger lift systems for removing liquids from a subterranean wellbore are disclosed herein. In one embodiment, the plunger lift system comprises a production string extending through the wellbore. In addition, the plunger lift system comprises a plunger piston assembly moveably disposed in the production string. The plunger piston assembly comprises a sealing sleeve having an upper end, a lower end, and a throughbore extending axially from the upper end of the sealing sleeve to the lower end of the sealing sleeve. The plunger piston assembly also comprises an intermediate sleeve disposed below the sealing sleeve. The intermediate sleeve has an upper end, a lower end, and a throughbore extending axially from the upper end of the intermediate sleeve to the lower end of the intermediate sleeve. Further, the plunger piston assembly comprises a plug disposed below the intermediate sleeve. The plug is configured to be removably disposed in the throughbore of the intermediate sleeve. The plunger piston assembly has a divided arrangement with the intermediate sleeve and the plug spaced apart, and a nested arrangement with the sealing sleeve, the intermediate sleeve, and the plug removably coupled together. The plunger piston assembly is configured to descend at least partially through the production string in the divided arrangement and ascend in the production string in the nested arrangement.

Embodiments of methods for removing accumulated liquids from a subterranean wellbore with plunger piston assemblies are disclosed herein. In one embodiment, the plunger piston assembly comprises a plug, a sealing sleeve, and an intermediate sleeve. In that embodiment, the method comprises (a) dropping the plug of the plunger piston assembly down a production string and through accumulated liquids in the production string. Further, the method comprises (b) dropping the sealing sleeve and the intermediate sleeve of the plunger piston assembly down the production string and through accumulated liquids in the production string after (a). The intermediate sleeve is positioned between the plug and the sealing sleeve. Further, the method comprises (c) releasably receiving the plug into a receptacle at a lower end of the intermediate sleeve after (b). Still further, the method comprises (d) releasably receiving an upper end of the intermediate sleeve into a receptacle at a lower end of the sealing sleeve after (b). Moreover, the method comprises (e) pushing accumulated liquids in the production string disposed above the plunger piston assembly to the surface after (c) and (d).

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
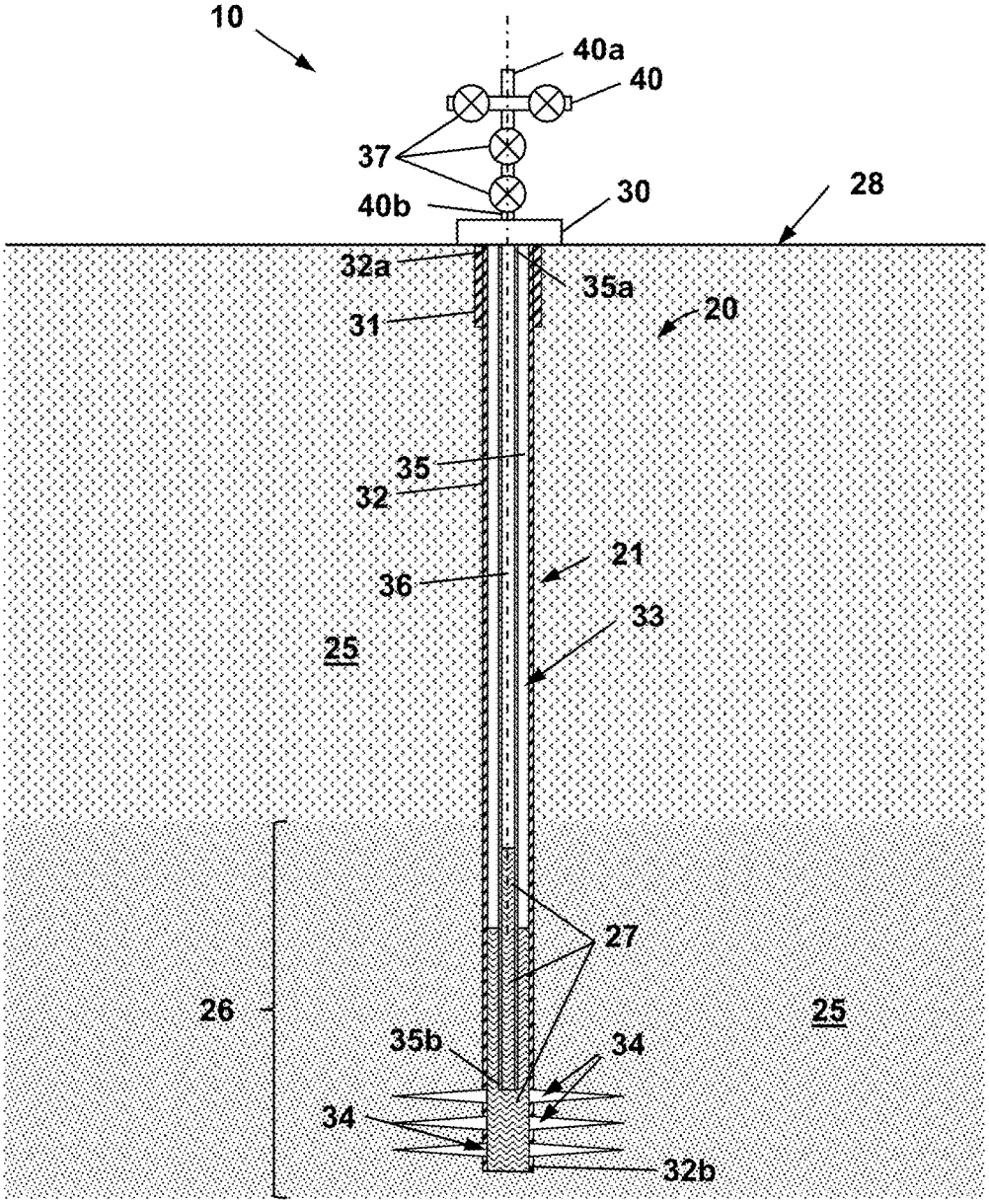
FIG. 1 is a schematic, partial cross-sectional view of an embodiment of a production system for producing hydrocarbon gases from a subterranean wellbore.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims will be made for purposes of clarity, with "up", "upper", "upwardly" or "upstream" meaning toward the surface of the borehole and with "down", "lower", "downwardly" or "downstream" meaning toward the terminal end of the borehole, regardless of the borehole orientation.

As previously described, plunger lift systems are one type of artificial lift technique for removing liquids from the production string of a gas well. However, many conventional plunger lift systems have disadvantages. One disadvantage of some conventional plunger lift systems is that the well must be shut-in to allow the free piston to fall through the production string. Wells that require artificial lift are often susceptible to being easily killed, and thus, shutting-in such wells can be risky. Another disadvantage of some conventional plunger systems is that the entire free piston periodically needs to be replaced, in some cases at least one a month. In particular, as the free piston is repeatedly dropped and lifted through the production string, the outer surface of the free piston slidingly engages the inner surface of the production string during its descent and ascent. Consequently, the outer surface of the free piston wears down over time. Once the outer diameter of the free piston decreases to sufficient degree, production fluids can bypass the free piston (i.e., flow between the piston and the production string), thereby decreasing the effectiveness and efficiency of the plunger lift system. Replacement of a few free pistons may not be particular costly, however, some gas well operators have hundreds or even thousands of gas wells that rely on plunger lift systems, and thus, replacing all the free pistons on those wells every few weeks can be costly. Still yet one more disadvantage of some conventional plunger lift systems is that due to the relatively long lengths of the free pistons (e.g., 6.0 to 18.0 in.), which slidingly engages the inner surface of the production string, there is an enhanced risk of the free pistons getting hung up at any anomalies or kinks on the inside of the production string. However, embodiments of plunger lift systems, plunger piston assemblies, and methods for removing liquids from gas wells offer the potential to overcome these disadvantages.

Referring now to FIG. 1, a system 10 for producing hydrocarbon gas from a well 20 is shown. Well 20 includes a wellbore 21 that extends through a subterranean hydrocarbon bearing formation 25. System 10 includes a wellhead 30 at the upper end of the wellbore 21, a production tree 40 mounted to wellhead 30, a primary conductor 31 extending from wellhead 30 into wellbore 21, a casing string ("casing") 32 coupled to wellhead 30 and extending concentrically through primary conductor 31 into wellbore 21, and a production conduit or string 35 coupled to tree 40 and extending through casing 32 into wellbore 21. An annulus 33 is formed between production string 35 and casing 32.

Casing 32 is cemented in wellbore 21 and has a first or upper end 32*a* coupled to wellhead 30 and a second or lower end 32*b* disposed in wellbore 21. A plurality of holes or perforations 34 are provided in casing 32 proximal lower end 32*b*. Perforations 34 allow formation fluids (e.g., hydrocarbon liquids, hydrocarbon gases, water, etc.) in formation 25 to pass through casing 32 into wellbore 21. String 35 has a central or longitudinal axis 36, a first or upper end 35*a* coupled to wellhead 30, and a second or lower end 32*b* disposed in wellbore 21.

Figure 2:
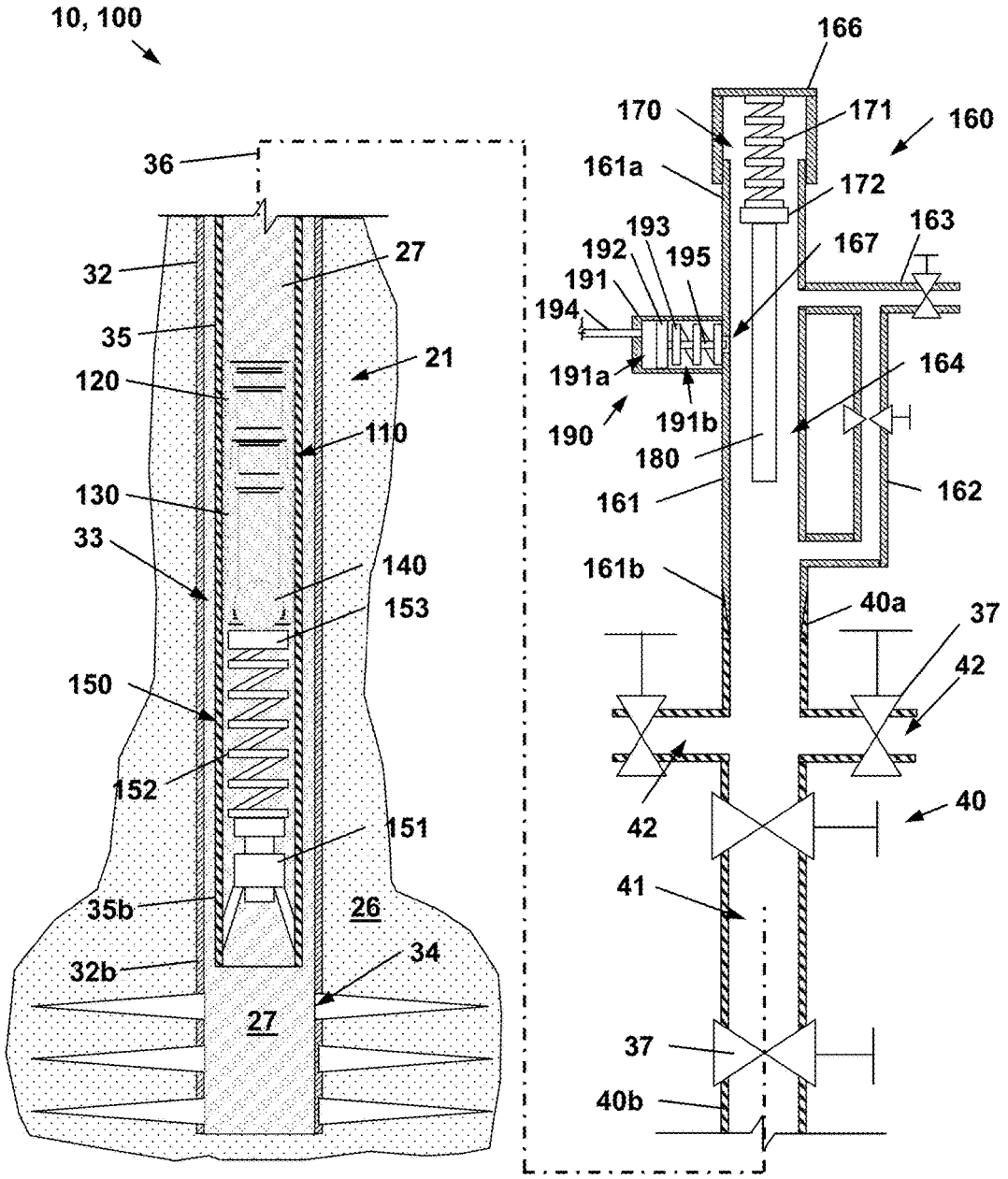
FIG. 2 is a schematic, partial cross-sectional view of an embodiment of a plunger lift system in accordance with the principles described herein for removing accumulated liquids from the production system of FIG. 1.

Referring now to FIGS. 1 and 2, production tree 40 has a first or upper end 40*a* and a second or lower end 40*b* secured to wellhead 30. In addition, tree 40 has a vertical passage or bore 41 extending between ends 40*a*, 40*b* and a pair of radial passages or bores 42 extending laterally from vertical bore 41. Vertical bore 41 is coaxially aligned with production string 35 (i.e., bore 41 has a central axis aligned with axis 36 of string 35) and is in fluid communication with production string 35. The diameter of bore 41 is substantially the same as the inner diameter of production string 35, and thus, there is a generally contiguous, smooth transition between bore 41 and production string 35. A pair of valves 37 are disposed along vertical bore 41 below radial bores 42, and a valve 37 is disposed along each radial bore 42. Valves 37 are operated to control the flow of fluids through bores 41, 42.

Referring again to FIG. 1, during production operations, formation fluids including hydrocarbon gases and liquids, and water flow into the wellbore 21 from a production zone 26 of formation 25 via perforations 34 in casing 32. Thereafter, the produced fluids flow to the surface 28 through production string 35. The pressure inside string 35 is typically less than the pressure in annulus 33, and thus, the formation fluids migrate into string 35 and are produced through string 35. In many cases, the formation 25 initially produces gas with sufficient pressure and volumetric flow rate to lift liquids that may accumulate in the bottom of wellbore 21 and casing 32 (i.e., production gas velocities are above the "Critical Velocity"). However, over time, the formation pressure and volumetric flow rate of the gas entering wellbore 21 from formation 25 decreases until it is no longer capable of lifting liquids that accumulate in wellbore 21 to the surface 28. The droplets of liquids accumulating in the bottom of the wellbore 21 form a column of liquid in casing 32 that imposes an undesirable back-pressure on the production zone 26, which undesirably restricts and/or prevents the flow of gas into wellbore 21 and negatively affects the production capacity of the well 20. For purposes of clarity and further explanation, the accumulated liquids in wellbore 21 are designated with reference numeral 27.

Referring now to FIG. 2, an embodiment of a plunger lift system 100 for removing accumulated liquids 27 (e.g., hydrocarbon liquids, condensate, water, etc.) from the lower end of production string 35, and hence casing 32, is shown. In this embodiment, plunger lift system 100 includes a free or plunger piston assembly 110 moveably disposed in string 35, a downhole or lower bumper 150 mounted within production string 35 proximal lower end 35*b*, and a lubricator 160 coupled to upper end 40*a* of production tree 40. Lubricator 160 includes an upper bumper 170 and a striking rod 180 disposed therein. As will be described in more detail below, plunger piston assembly 110 moves through vertical bore 41 of tree 40, production string 35, and lubricator 160 as it cyclically ascends and descends between bumpers 150, 170 to remove liquids 27 from production string 35.

In many gas wells that are susceptible to or suffer from the accumulation of liquids, the production string is 2⅜ in. tubing, having an inner diameter of 1.995 in., or 2⅞ in. tubing, having an inner diameter of 2.441 in. Accordingly, in some embodiments of plunger lift system 100, production string 35 is 2⅜ in. tubing with an inner diameter of 1.995 in. or 2⅞ in. tubing having an inner diameter of 2.441 in.

Referring now to FIGS. 2-5, in this embodiment, plunger piston assembly 110 is a three-piece piston including an upper sleeve 120, a lower sleeve 130, and a plug 140. Sleeve 130 is the lower of the two sleeves 120, 130, but is positioned between sleeve 120 and plug 140. Accordingly, lower sleeve 130 may also be referred to herein as "intermediate" sleeve 130. As will be described in more detail below, upper sleeve 120 slidingly engages and forms a dynamic seal with production string 35, whereas intermediate sleeve 130 may slidingly engage production tubing but does not necessarily form a dynamic seal with production tubing 15. Therefore, upper sleeve 120 may also be referred to herein as "sealing" sleeve 120. In this embodiment, plug 140 is a spherical ball.

Figure 3:
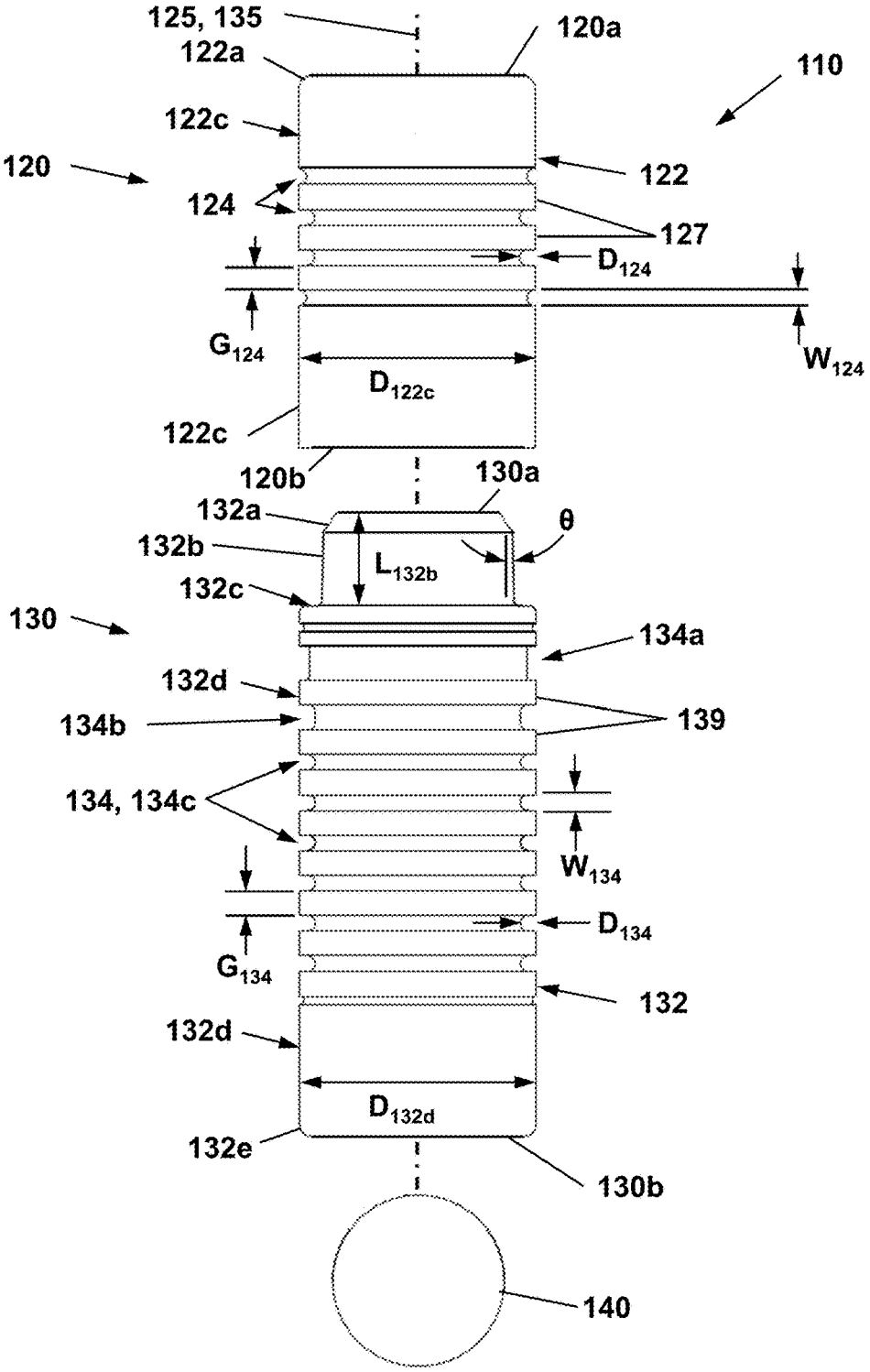
FIG. 3 is a front view of the plunger piston assembly of FIG. 2 in the divided arrangement.
Figure 4:
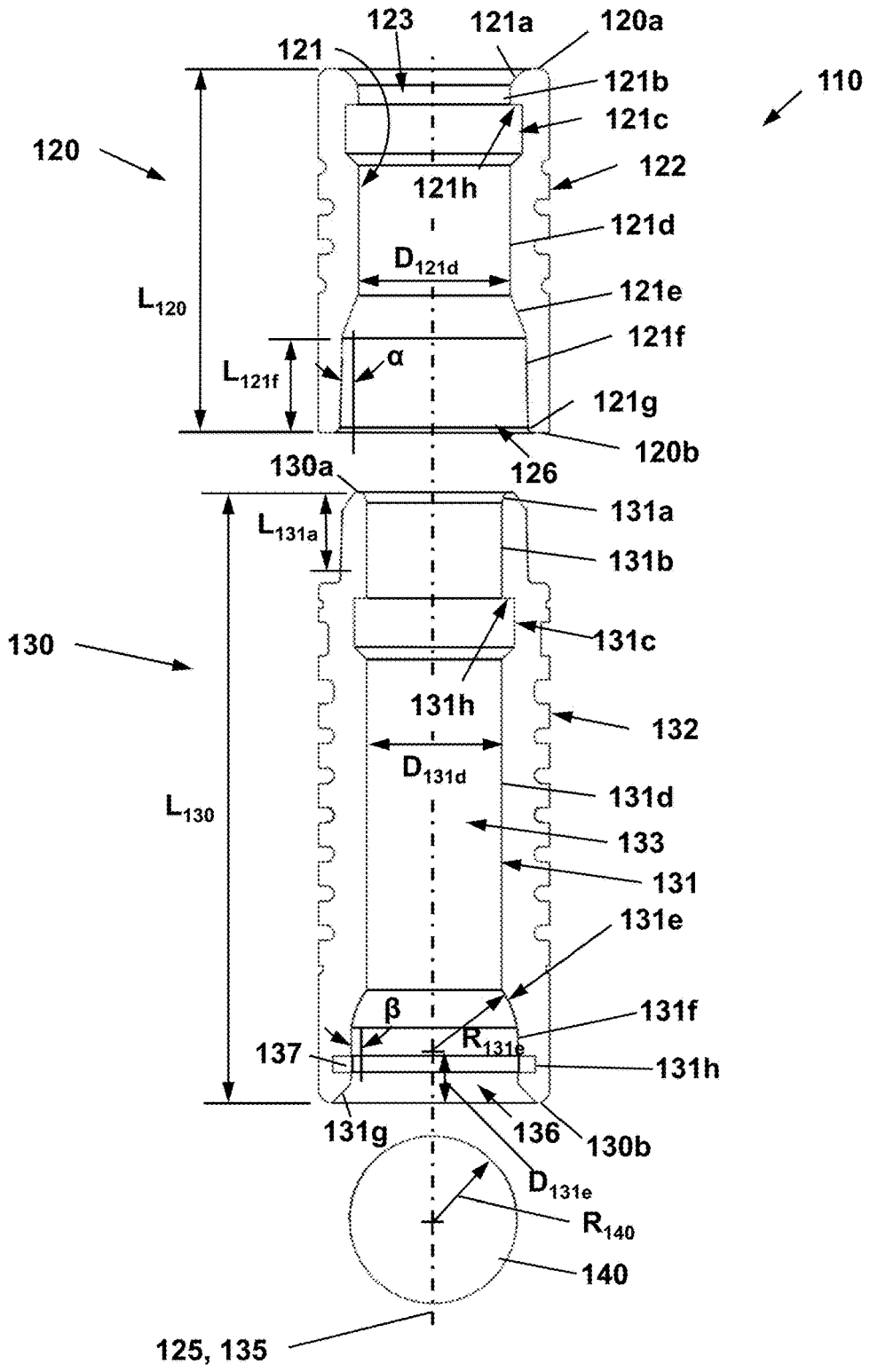
FIG. 4 is an exploded cross-sectional view of the plunger piston assembly of FIG. 2 in the divided arrangement.
Figure 5:
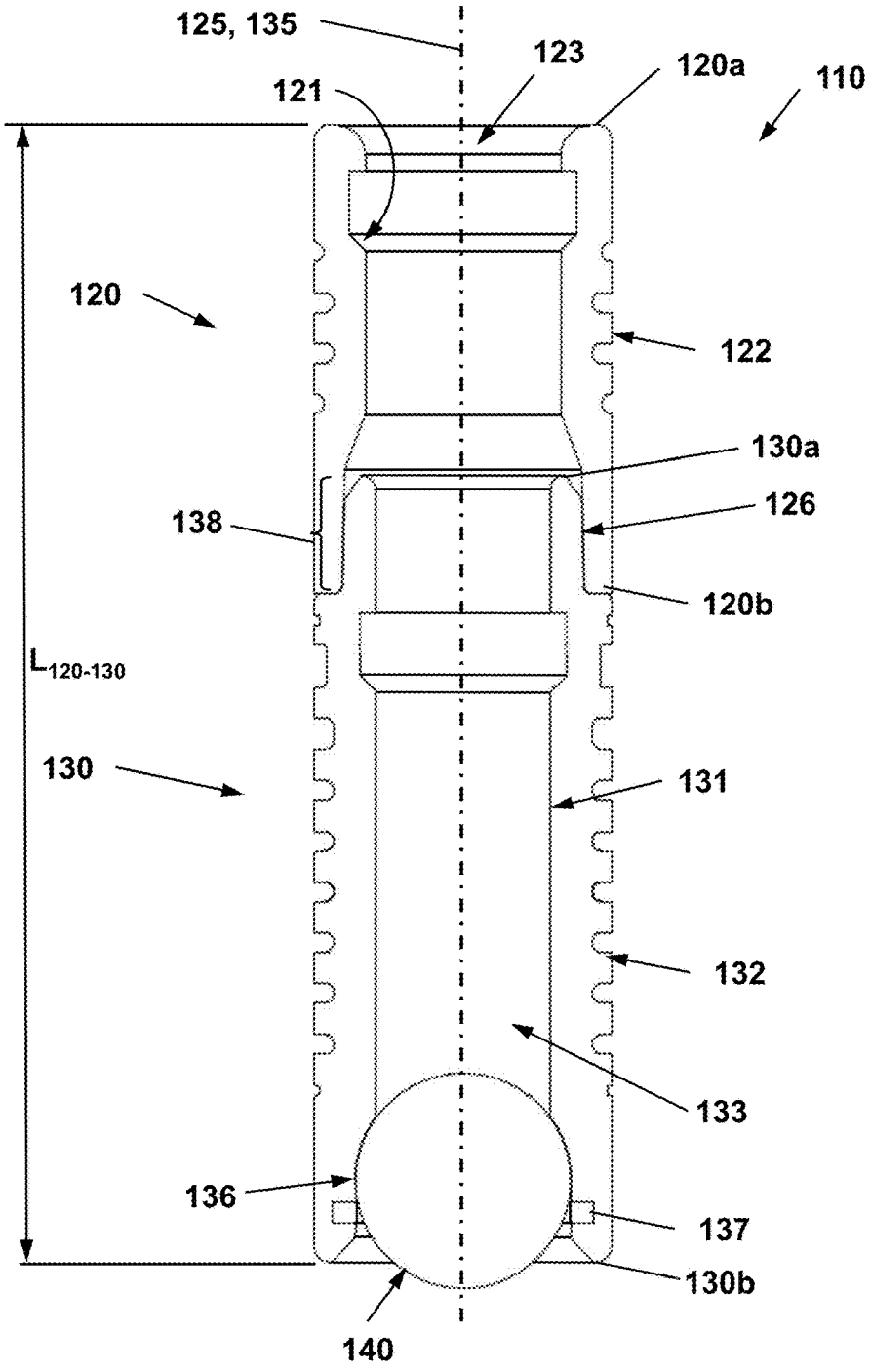
FIG. 5 is a cross-sectional view of the plunger piston assembly of FIG. 2 in the nested arrangement.

Sleeve 120, sleeve 130, and plug 140 are generally free to move independent of each other, but are sized and shaped to nest together at lower bumper 150 and ascend together as a unitary assembly. For example, in FIGS. 3 and 4, sleeves 120, 130, and ball 140 are divided or spaced apart, whereas in FIGS. 2 and 5, sleeves 120, 130, and ball 140 are nested together as a unitary assembly. Thus, the components of piston assembly 110 (i.e., sleeves 120, 130, and ball 140) and piston assembly 110 itself may be described as having a "nested" or "unitary" arrangement with both sleeves 120, 130, and ball 140 fully nested together as shown in FIGS. 2 and 5, and a "divided" or "spaced" arrangement with at least intermediate sleeve 130 and ball 140 spaced apart (e.g., sleeve 120, sleeve 130, and ball 140 all spaced apart or intermediate sleeve 130 and ball 140 spaced apart) as shown in FIGS. 3 and 4. Sleeves 120, 130, and ball 140 are coaxially aligned when piston assembly 110 is in the nested arrangement.

Each individual component of plunger piston assembly 110 (i.e., sleeve 120, sleeve 130, and ball 140) is a single-piece, unitary, monolithic structure. In general, each component of plunger piston assembly 110 can be made of any material that is durable and suitable for repeated downhole use. In general, the selection of materials for sleeve 120, sleeve 130, and ball 140 will depend on a variety of factors including, without limitation, material costs, ease of manufacture, durability, the gas and liquid production of the well, surface pressures (tubing, casing, and/or line pressure), the flowing bottom hole pressures, etc. In this embodiment, each sleeve 120, 130 is made of steel (4140 carbon steel). Ball 140 is preferably made of titanium, zirconium, steel, cobalt, or tungsten. In this embodiment, ball 140 is made of steel. Wear resistant coatings can be added to the outer surface of sleeve 120, sleeve 130, ball 140 or combinations thereof. Examples of suitable wear resistant coatings include, without limitation, boron or boron containing coatings, nickel or nickel alloy coatings, nitrate coatings, Quench Polish Quench (QPQ) coatings, carbonized coatings, and plasma EXC coatings.

Referring now to FIGS. 3-5, sealing sleeve 120 is a generally tubular member having a central or longitudinal axis 125, a first or upper end 120*a*, a second or lower end 120*b*, a radially inner surface 121 extending axially between ends 120*a* to end 120*b*, and a radially outer surface 122 extending axially between ends 120*a*, 120*b*. In this embodiment, each end 120*a*, 120*b* of sealing sleeve 120 comprises an annular planar surface extending radially from inner surface 121 to outer surface 122. Sleeve 120 has a length $L_{120}$ measured axially from end 120*a* to end 120*b*. Length $L_{120}$ is preferably less than or equal to 12.00 in., more preferably between 2.0 in. and 12.00 in., even more preferably between 2.00 and 6.00 in., and still even more preferably between 2.00 and 4.00 in. In this embodiment, length $L_{120}$ is 3.00 in. As will be described in more detail below, the length $L_{120}$ of sealing sleeve 120 may be influenced by the location of a catcher 190 that is coupled to lubricator 160 and functions to hold sleeves 120, 130 at lubricator 160 for a specific amount of time. It should also be appreciated that the material costs associated with manufacturing sealing sleeve 120 and the likelihood of sealing sleeve 120 getting hung up within production tubing 35 as it moves therethrough are generally reduced as the length $L_{120}$ is decreased. Consequently, a reduced length $L_{120}$ may be preferred in some embodiments.

Inner surface 121 defines a central throughbore or passage 123 extending axially through sleeve 120 from upper end 120*a* to lower end 120*b*. As will be described in more detail below, as sealing sleeve 120 falls through production string 35 independent of intermediate sleeve 130 and ball 140, fluids in string 35 are free to flow through passage 123, thereby bypassing sleeve 120 and allowing sleeve 120 to fall therethrough. As best shown in FIG. 4, moving axially from upper end 120*a* to lower end 120*b*, in this embodiment, inner surface 121 includes a convex radiused surface 121*a* extending axially from upper end 120*a*, a cylindrical surface 121*b* axially adjacent surface 121*a*, an annular recess 121*c* axially adjacent surface 121*b*, a cylindrical surface 121*d* axially adjacent recess 121*c*, a frustoconical surface 121*e* axially adjacent surface 121*d*, a frustoconical surface 121*f* axially adjacent surface 121*e*, and an annular bevel 121*g* extending axially from surface 121*f* to lower end 120*b*. Thus, recess 121*c* extends axially between surfaces 121*b*, 121*d*, cylindrical surface 121*d* extends axially from recess 121*c* to surface 121*e*, and seating surface 121*f* extends axially from surface 121*e* to bevel 121*g*. A downward-facing planar annular shoulder 121*h* extends radially between surface 121*a* and recess 121*b*. Shoulder 121*h* is disposed in a plane oriented perpendicular to axis 125 and defines a fishing lip proximal upper end 120*a* for retrieving upper sleeve 120 in the event it gets stuck.

Although frustoconical surface 121*e* is provided between cylindrical surface 121*d* and seating surface 121*f* in this embodiment, in other embodiments, frustoconical surface 121*e* may be eliminated such that seating surface 121*f* extends axially to cylindrical surface 121*d*. Moreover, although surface 121*a* is radiused and surface 121*g* is beveled in this embodiment, in general, the upper most portion of inner surface 121 (e.g., surface 121*a*) may be radiused or beveled and the lower most portion of inner surface 121 (e.g., surface 121*g*) may be radiused or beveled. Moreover in some embodiments, neither a radiused surface nor bevel is provided at the upper most portion of inner surface 121 (e.g., surface 121*a* is eliminated) and/or neither a radius surface nor bevel is provided at the lower most portion of inner surface 121 (e.g., surface 121*g* is eliminated).

Referring still to FIG. 4, in this embodiment, seating surface 121*f* is a frustoconical surface is oriented at an angle $\alpha$ relative to central axis 125 and has a length $L_{121f}$ measured axially from bevel 121*g* proximal lower end 120*b* to surface 121*e*. Angle $\alpha$ is preferably between 0.5° and 20°, and more preferably between 1° and 6°. In this embodiment, angle $\alpha$ is 1.4885°. As will be described in more detail below, surface 121*f* of sealing sleeve 120 slidingly and sealingly engages a mating surface provided at the upper end of intermediate sleeve 130 in the nested arrangement. Thus, length $L_{121f}$ of surface 121*f* (and the length of the mating surface of intermediate sleeve 130) are preferably sufficient to enable such sliding and sealing engagement. For most applications, length $L_{121f}$ is preferably greater than 0.50 in., and more preferably greater than 1.00 in. In this embodiment, length $L_{121f}$ is about 1.30 in. Since the upper end of intermediate sleeve 130 is seated against surface 121*f* in the nested arrangement, surface 121*f* may be referred to as a "seating" surface 121*f*, or described as defining a receptacle 126 at lower end 120*b* of sealing sleeve 120 that receives the upper end of intermediate sleeve 130.

Sealing sleeve 120 has an inner diameter that varies moving axially along inner surface 121. In this embodiment, cylindrical surface 121*d* is disposed at a diameter $D_{121d}$ that defines the minimum inner diameter of sealing sleeve 120. In embodiments of plunger lift system 100 where production string 35 has an inner diameter of 1.995 in. (i.e., production string 35 is 2⅜ in. tubing), diameter $D_{121d}$ is preferably between 0.75 in. and 1.40 in., and more preferably between 1.20 in. and 1.25 in.; and in embodiments of plunger lift system 100 where production string 35 has an inner diameter of 2.441 in. (i.e., production string 35 is 2⅞ in. tubing) diameter $D_{121d}$ is preferably between 0.75 in. and 2.00 in., more preferably between 1.25 in. and 1.75 in., and even more preferably 1.57 in. In this embodiment, production string 35 has an inner diameter of 1.995 in. and diameter $D_{121d}$ of cylindrical surface 121*d* is 1.25 in.

Referring now to FIG. 3, outer surface 122 of sealing sleeve 120 includes an annular convex radiused surface 122*a* extending axially from upper end 120*a* and a cylindrical surface 122*c* extending axially from lower end 120*b* to surface 122*a*.

Although surface 122*a* is radiused in this embodiment and cylindrical surface 122*c* extends to lower end 120*b*, in other embodiments, the upper most portion of outer surface 122 (e.g., surface 122*a*) may be beveled instead of radiused, an annular convex radiused or beveled surface may be provided between cylindrical surface 122*c* and lower end 120*b*, or combinations thereof. Moreover, in some embodiments, neither a radiused surface nor bevel is provided at the upper most portion of outer surface 122 (e.g., surface 122*a* is eliminated).

A plurality of axially spaced annular recesses or grooves 124 are provided along cylindrical surface 122*c*. The plurality of spaced grooves 124 define a plurality of axially spaced annular lips or ribs 127. Each pair of axially adjacent grooves 124 are spaced apart a minimum axial distance $G_{124}$. In addition, each groove 124 has an axial width $W_{124}$ and a radial depth $D_{124}$. The axial distance $G_{124}$ between adjacent grooves 124 is preferably between 0.10 in. and 0.50 in., and more preferably between 0.10 in. and 0.30 in.; the axial width $W_{124}$ of each groove 124 is preferably between 0.075 in. and 0.400 in., and more preferably between 0.075 in. and 0.175 in.; and the radial depth $D_{124}$ of each groove 124 is preferably between 0.075 in. and 0.250 in., and more preferably between 0.075 in. and 0.175 in. In this embodiment, each groove 124 is the same, and further, axial distance $G_{124}$ between each pair of adjacent grooves 124 is 0.20 in., the axial width $W_{124}$ of each groove is 0.125 in., and the radial depth $D_{124}$ of each groove is 0.125 in. In this embodiment, each groove 124 is an annular concave recess having C-shaped cross-section, however, in other embodiments, the grooves along outer surface 122 (e.g., grooves 124) have a rectangular cross-section.

Cylindrical surface 122*c* and annular grooves 124 therein form a sealing system or arrangement that restricts and/or prevents fluids in production string 35 from passing between sleeve 120 and string 35. More specifically, cylindrical surface 122*c* is disposed at an outer diameter $D_{122c}$ that defines the maximum outer diameter of sealing sleeve 120. Diameter $D_{122c}$ is substantially the same or slightly less (~1-6% less) than the inner diameter of production string 35 within which it is disposed. Thus, cylindrical surface 122*c* slidingly engages production string 35 and forms a dynamic seal with production string 35 as sealing sleeve 120 moves therethrough. Annular grooves 124 reduce drag and friction between sealing sleeve 120 and production string 35, while simultaneously facilitating a turbulent zone between sealing sleeve 120 and production string 35 that restricts fluid flow therebetween. Grooves 124 also offer the potential to reduce the likelihood of sealing sleeve 120 getting hung up in production tubing 35. In particular, grooves 124 provide a space to accommodate any solids (e.g., sand, scale, etc.) in the wellbore 21, which may otherwise become lodged between surface 122*c* and production string 35, thereby increasing friction between sealing sleeve 120 and production string 35.

In embodiments of plunger lift system 100 where production string 35 has an inner diameter of 1.995 in. (i.e., production string 35 is 2⅜ in. tubing), outer diameter $D_{122c}$ is preferably greater than or equal to 1.89 in. and less than 1.995 in., and more preferably greater than or equal to 1.89 in. and less than or equal 1.95 in.; and in embodiments of plunger lift system 100 where production string 35 has an inner diameter of 2.441 in. (i.e., production string 35 is 2⅞ in. tubing), outer diameter $D_{122c}$ is preferably greater than or equal to 2.165 in. and less than 2.441 in., and more preferably greater than or equal to 2.320 in. and less than or equal 2.360 in. In this embodiment, production string 35 has an inner diameter of 1.995 in. and diameter $D_{122c}$ is 1.90 in. As described in more detail below, embodiments of sealing sleeve 120 described herein have a relatively larger outer diameter (e.g., outer diameter $D_{122c}$) as compared to conventional plunger pistons designed for use with production strings having an inner diameter of 1.995 in.

Referring again to FIG. 4, intermediate sleeve 130 is a generally tubular member having a central or longitudinal axis 135, a first or upper end 130*a*, a second or lower end 130*b*, a radially inner surface 131 extending axially between ends 130*a* to end 130*b*, and a radially outer surface 132 extending axially between ends 130*a*, 130*b*. Sleeve 130 has a length $L_{130}$ measured axially from end 130*a* to end 130*b*. In general, length $L_{130}$ can be the same or different than length $L_{120}$ of sealing sleeve 120. However, for most applications, and in this embodiment, length $L_{130}$ is greater than length $L_{120}$. In this embodiment, length $L_{130}$ is preferably between 3.00 in. and 12.00 in., and more preferably between 4.00 and 6.00 in. In this embodiment, length $L_{130}$ is about 5.00 in. As previously described, the length $L_{120}$ of sleeve 120 is preferably less than or equal to 12.00 in., more preferably between 2.0 in. and 12.00 in., even more preferably between 2.00 and 6.00 in., and still even more preferably between 2.00 and 4.00 in. Thus, as best shown in FIG. 5, the total collective length $L_{120\text{-}130}$ of sleeves 120, 130 when nested together can range from 5.0 in. to 24.0 in.

Inner surface 131 defines a central throughbore or passage 133 extending axially through sleeve 130 from upper end 130*a* to lower end 130*b*. As will be described in more detail below, as intermediate sleeve 130 falls through production string 35 independent of sealing sleeve 120 and ball 140, fluids in string 35 are free to flow through passage 133, thereby bypassing sleeve 130. Moving axially from upper end 130*a* to lower end 130*b*, in this embodiment, inner surface 131 includes an annular convex radiused surface 131*a* extending axially from upper end 130*a*, a cylindrical surface 131*b* extending axially from surface 131*a*, an annular recess 131*c* axially adjacent surface 131*b*, a cylindrical surface 131*d* axially adjacent recess 131*c*, an annular concave hemispherical seating surface 131*e* axially adjacent from surface 131*d*, a guide surface 131*f* extending tangentially and axially from surface 131*e*, and an annular bevel 131*g* extending axially between guide surface 131*f* and lower end 130*b*. Thus, recess 131*c* extends axially between cylindrical surfaces 131*b*, 131*d*, cylindrical surface 131*d* extends axially from recess 131*c* to hemispherical surface 131*e*, and hemispherical surface 131*e* extends axially from cylindrical surface 131*d* to guide surface 131*f*. A downward-facing planar annular shoulder 131*h* extends radially between surface 131*b* and recess 131*c*. Shoulder 131*h* defines a fishing lip proximal upper end 130*a* for retrieving intermediate sleeve 130 in the event it gets stuck.

Although radiused surface 131*a* is provided between cylindrical surface 131*b* and upper end 130*a*, and bevel 131*g* is provided between guide surface 131*f* and lower end 130*b* in this embodiment, in other embodiments, the upper most portion of inner surface 131 (e.g., surface 131*a*) may be radiused or beveled and the lower most portion of inner surface 131 (e.g., surface 131*g*) may be radiused or beveled. Moreover in some embodiments, neither a radiused surface nor bevel is provided at the upper most portion of inner surface 131 (e.g., surface 131*a* is eliminated) and/or neither a radius surface nor bevel is provided at the lower most portion of inner surface 131 (e.g., surface 131*g* is eliminated).

Referring still to FIG. 4, hemispherical surface 131*e* has a radius of curvature disposed a radius $R_{131}e$ and guide surface 131*f* is oriented at an angle β relative to central axis 135. As will be described in more detail below, guide surface 131*f* is sized and shaped to funnel and guide ball 140 into hemispherical surface 131*e*, and hemispherical surface 131*e* is sized and shaped to receive, mate, and slidingly engage ball 140 as shown in FIG. 5. Ball 140 has an outer radius $R_{140}$, and thus, radius $R_{131e}$ is substantially the same or slightly greater than radius $R_{140}$ to enable ball 140 to be received therein, as well as mating engagement between ball 140 and surface 131*e*. In this embodiment, radius $R_{140}$ is 0.6875 in. and radius $R_{131e}$ is 0.6895 in. Further, in this embodiment, guide surface 131*f* is a frustoconical surface oriented at an angle β preferably between 5° and 20°. In this embodiment, angle β is 11°. Although guide surface 131*f* is a frustoconical surface disposed at angle β in this embodiment, in other embodiments, the guide surface (e.g., guide surface 131*f*) may be a smoothly curved concave surface that is oriented at is vertically oriented proximal lower end 130*b* and smoothly curves and transitions to the radius $R_{131e}$.

Figure 6:
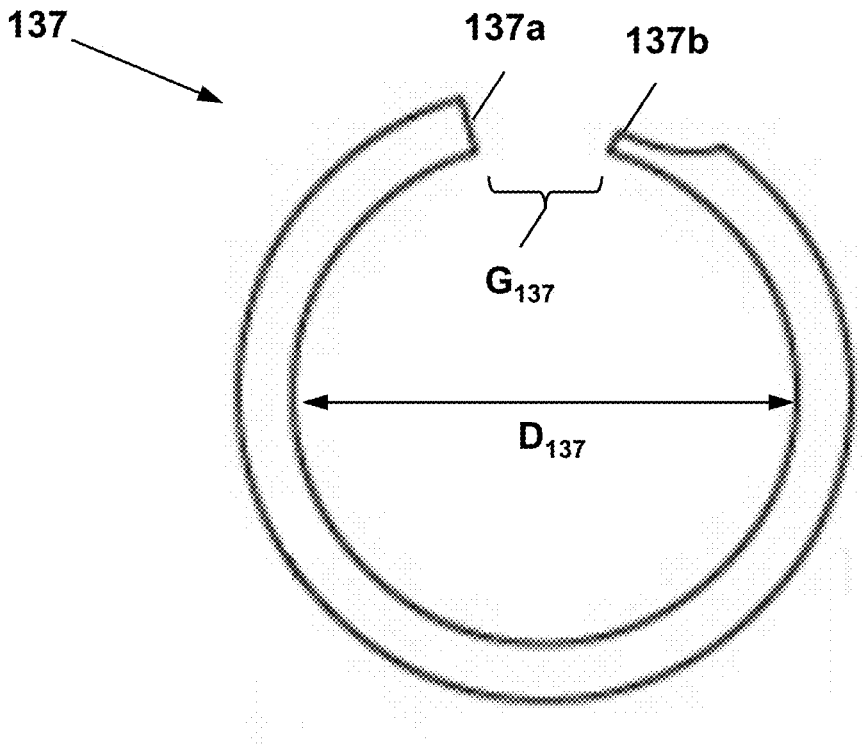
FIG. 6 is a top view of the snap ring of FIG. 4.

In this embodiment, an annular groove 131*h* is provided along guide surface 131*f* and a snap ring 137 is seated in groove 131*h*. As best shown in FIGS. 6A and 6B, snap ring 137 includes a slot or gap $G_{138}$ defining opposed ends 137*a*, 137*b*. Thus, snap ring 137 is a C-shaped ring. Gap 138 allows ring 137 to flex such that ends 137*a*, 137*b* can be urged away from and toward each other, thereby allowing the inner diameter $D_{137}$ of ring 137 to slightly increase and decrease. In this embodiment, the inner diameter $D_{137}$ of snap ring 137 when snap ring 137 is relaxed (i.e., not flexed) is slightly less than the outer diameter of ball 140, but snap ring 137 can be flexed radially outward to increase diameter $D_{137}$ to or slightly greater than the outer diameter of ball 140, thereby allowing ball 140 to pass therethrough. Once ball 140 passes through snap ring 137, it springs back to its relaxed inner diameter $D_{137}$. Thus, snap ring 137 may be described as being biased to its relaxed inner diameter $D_{137}$, which is slightly less than the outer diameter of ball 140. For example, in embodiments where ball 140 has an outer diameter of 1.375 in., snap ring 137 has a relaxed inner diameter $D_{137}$ of 1.336 in., and in embodiments where ball as an outer diameter of 1.680 in., snap ring 137 has a relaxed inner diameter $D_{137}$ of 1.626 in. Snap ring 137 is preferably made of a durable rigid resilient material such as steel (carbon steel, stainless steel, etc.) that enables snap ring 137 to be repeatedly flexed.

Referring now to FIGS. 4 and 5, guide surface 131*f* guides ball 140 into mating engagement with hemispherical seating surface 131*e*. Thus, surfaces 131*e*, 131*f* may be described as defining a receptacle 136 at the lower end 130*b* of intermediate sleeve 130 that receives ball 140. When ball 140 is fully seated against surface 131*e* (FIG. 5), ball 140 closes off throughbore 133 at lower end 130*b* and blocks the flow of fluids therethrough. The geometric, radial center of hemispherical surface 131*e* is disposed at a depth $D_{131e}$ measured axially from lower end 130*b* that is less than the radius $R_{140}$ of ball 140, and thus, when ball 140 is fully seated against surface 131*e* (FIG. 5), ball 140 projects axially from receptacle 136 and lower end 130*b* of intermediate sleeve 130. As will be described in more detail below, this arrangement prevents intermediate sleeve 130 from impacting lower bumper 150 when sleeve 130 receives ball 140 into receptacle 136 at bumper 150, thereby reducing the potential for damaging bumper 150 or sleeve 130. It should also be appreciated that the geometric, radial center of hemispherical surface 131*e* is disposed axially above snap ring 137. Thus, as ball 140 passes through receptacle 136 toward seating surface 131*e*, ball 140 urges the ends 137*a*, 173*b* of snap ring 137 apart, thereby increasing the inner diameter $D_{137}$ of snap ring 137 so that ball 140 can pass therethrough and seat against surface 131*e*. Once ball 140 is sufficiently seated against surface 131*e*, snap ring 137 can return to its relaxed inner diameter $D_{137}$ as the center of ball 140 defining the maximum width (full outer diameter) is disposed above snap ring 137. The relaxed inner diameter $D_{137}$ of snap ring 137 is less than the outer diameter of ball 140, and thus, once snap ring 137 returns to its relaxed inner diameter $D_{137}$, it helps maintain seating of ball 140 against surface 131*e* and restricts and/or prevents ball 140 from inadvertently falling out of receptacle 136.

Referring again to FIG. 4, intermediate sleeve 130 has an inner diameter that varies moving axially along inner surface 131. In this embodiment, cylindrical surfaces 131*b*, 131*d* are both disposed at the same diameter $D_{131d}$ that defines the minimum inner diameter of intermediate sleeve 130. In embodiments of plunger lift system 100 where production string 35 has an inner diameter of 1.995 in. (i.e., production string 35 is 2⅜ in. tubing), diameter $D_{131d}$ is preferably between 0.75 in. and 1.40 in., and more preferably between 0.95 in. and 1.12 in.; and in in embodiments of plunger lift system 100 where production string 35 has an inner diameter of 2.441 in. (i.e., production string 35 is 2⅞ in. tubing), diameter $D_{131d}$ is preferably between 0.75 in. and 2.00 in., and more preferably between 1.04 in. and 1.37 in. In this embodiment, production string 35 has an inner diameter of 1.995 in. and diameter $D_{131d}$ of cylindrical surfaces 131*b*, 131*d* is 1.12 in.

Referring now to FIG. 3, moving axially from upper end 130*a* to lower end 130*b*, outer surface 132 of intermediate sleeve 130 includes an annular bevel 132*a* adjacent upper end 130*a*, a frustoconical surface 132*b* extending axially bevel 132*a*, an annular shoulder 132*c* axially adjacent surface 132*b*, a cylindrical surface 132*d* extending from shoulder 132*c*, and an annular radiused surface 132*e* extending axially between cylindrical surface 132*d* and lower end 130*b*. A plurality of axially spaced annular recesses or grooves 134 are provided along cylindrical surface 132*d*. The plurality of spaced grooves 134 define a plurality of axially spaced annular lips or ribs 139.

Although bevel 131*a* is provided between frustoconical surface 132*b* and end 130*a*, and radiused surface 132*e* is provided between cylindrical surface 132*d* and end 130*b* in this embodiment, in other embodiments, the upper most portion of outer surface 132 (e.g., surface 132*a*) may be radiused or beveled and the lower most portion of outer surface 132 (e.g., surface 132*e*) may be radiused or beveled. Moreover in some embodiments, neither a radiused surface nor bevel is provided at the upper most portion of outer surface 132 (e.g., bevel 132*a* is eliminated) and/or neither a radius surface nor bevel is provided at the lower most portion of outer surface 132 (e.g., surface 132*e* is eliminated).

Frustoconical surface 132*b* is oriented at an angle θ relative to central axis 135 and extends to a length $L_{132b}$ measured axially from upper end 130*a* to shoulder 132*c*. As shown in FIG. 5, bevel 132*a* and frustoconical surface 132*b* defines a stabbing member 138 at upper end 130*a* that is sized and shaped to mate with receptacle 126 at lower end 120*b* of sealing sleeve 120 and slidingly engage mating seating surface 121*f*. Thus, angle θ is preferably the same as angle α of seating surface 121*f* Thus, angle θ is preferably between 1° and 20°, and more preferably between 1° and 6°. In this embodiment, angle θ is 4°. In addition, length $L_{132b}$ is preferably sufficiently long to enable the full, annular sliding and sealing engagement of surfaces 132*b*, 121*f* when lower end 120*b* axially abuts shoulder 132*c*. In this embodiment, length $L_{132b}$ is equal to or less than $L_{121f}$, and in particular, length $L_{132b}$ is about 0.75 in.

Referring still to FIG. 3, each pair of axially adjacent grooves 134 are spaced apart an axial distance $G_{134}$. In addition, each groove 134 has an axial width $W_{134}$, and a radial depth $D_{134}$. In this embodiment, the axial distance $G_{134}$ between each pair of axially adjacent grooves 134 is the same, and the radial depth $D_{134}$ of each groove 134 is the same. In particular, the axial distance $G_{134}$ between adjacent grooves 134 is preferably between 0.10 in. and 0.50 in., and more preferably between 0.10 in. and 0.30 in.; and the radial depth $D_{134}$ of each groove 134 is preferably between 0.075 in. and 0.250 in., and more preferably between 0.075 in. and 0.175 in. In this embodiment, the axial distance $G_{134}$ between each pair of adjacent grooves 134 is 0.20 in., and the radial depth $D_{134}$ of each groove is 0.125 in. However, in this embodiment, the axial width $W_{134}$ of each groove 134 is not the same. More specifically, the plurality of grooves 134 include a first or upper groove 134*a*, and a second groove 134*b* axially adjacent groove 134*a*, and a plurality of grooves 134*c* axially positioned between groove 134*b* and lower end 130*b*. The axial width $W_{134}$ of each groove 134*c* is the same. However, the axial width $W_{134}$ of groove 134*a* is greater than the axial width $W_{134}$ of groove 134*b*, which is greater than the axial width $W_{134}$ of each groove 134*c*. In particular, the axial width $W_{134}$ of each groove 134*c* is preferably between 0.075 in. and 0.400 in., and more preferably between 0.075 in. and 0.175 in.; the axial width $W_{134}$ of groove 134*a* is preferably between 0.125 in. and 0.50 in., and more preferably 0.20 in. and 0.30 in.; and the axial width $W_{134}$ of groove 134*b* is preferably between 0.125 in. and 0.50 in., and more preferably between 0.15 and 0.25. In this embodiment, axial width $W_{134}$ of each groove 134*c* is 0.1250 in., axial width $W_{134}$ of groove 134*a* is 0.2720 in., and axial width $W_{134}$ of groove 134*b* is 0.20 in. In this embodiment, each groove 134 is an annular concave recess having C-shaped cross-section, however, in other embodiments, the grooves along outer surface 132 (e.g., grooves 134) have a rectangular cross-section.

As will be described in more detail below, upper groove 134*a* functions as a primary "catch" groove or receptacle designed to receive a pin that temporarily holds sleeves 120, 130 at lubricator 160 and groove 134*b* functions as a secondary or backup "catch" groove or receptacle designed to receive a pin that temporarily holds sleeves 120, 130 at lubricator 160. Grooves 134*a*, 134*b* have greater axial widths $W_{134}$ than grooves 134*c* to provide a margin for error in case the groove 134*a*, 134*b* is not perfectly aligned with the pin.

Cylindrical surface 132*d* is disposed at a diameter $D_{132d}$ that defines the maximum outer diameter of intermediate sleeve 130. In embodiments described herein, diameter $D_{132d}$ is equal to or less than the maximum outer diameter $D_{122c}$ of sealing sleeve 120. As previously described, outer diameter $D_{122c}$ of sealing sleeve 120 is substantially the same or slightly less (~1-6% less) than the inner diameter of production string 35. Thus, diameter $D_{132d}$ is substantially the same or less than the inner diameter of production string 35.

As previously described, in embodiments of plunger lift system 100 where production string 35 has an inner diameter of 1.995 in. (i.e., production string 35 is 2⅜ in. tubing), outer diameter $D_{122c}$ is preferably greater than or equal to 1.89 in. and less than 1.995 in., and more preferably greater than or equal to 1.89 in. and less than or equal to 1.95 in.; and in embodiments of plunger lift system 100 where production string 35 has an inner diameter of 2.441 in. (i.e., production string 35 is 2⅞ in. tubing), diameter $D_{122c}$ is preferably greater than or equal to 2.165 in. and less than 2.441 in., and more preferably greater than or equal to 2.320 in. and less than or equal 2.360 in. Thus, in embodiments of plunger lift system 100 where production string 35 has an inner diameter of 1.995 in. (i.e., production string 35 is 2⅜ in. tubing), diameter $D_{132d}$ is preferably greater than or equal to 1.89 in. and less than 1.995 in., and more preferably greater than or equal to 1.89 in. and less than or equal 1.95 in.; and in embodiments of plunger lift system 100 where production string 35 has an inner diameter of 2.441 in. (i.e., production string 35 is 2⅞ in. tubing), diameter $D_{132d}$ is preferably greater than or equal to 2.165 in. and less than 2.441 in., and more preferably greater than or equal to 2.320 in. and less than or equal 2.360 in. In this embodiment, production string 35 has an inner diameter of 1.995 in. and diameter $D_{132d}$ is 1.90 in. or 1.91 in.

In embodiments where diameter $D_{132d}$ is the same as diameter $D_{122c}$, surface 132*d* and grooves 134 form a sealing arrangement or system that restricts and/or prevents fluids in production string 35 from bypassing sleeve 130 between sleeve 130 and string 35. In particular, cylindrical surface 132*d* slidingly engages production string 35 and forms a dynamic seal with production string 35 as intermediate sleeve 130 moves therethrough, and annular grooves 134 reduce drag and friction between intermediate sleeve 130 and production string 35, while simultaneously facilitating a turbulent zone between intermediate sleeve 130 and production string 35 that restricts fluid flow therebetween. However, in embodiments where diameter $D_{132d}$ is less than diameter $D_{122c}$, surface 132*d* and grooves 134 restricts but do not necessarily prevent, fluids in production string 35 from bypassing sleeve 130 between sleeve 130 and string 35. In particular, since a diameter $D_{132d}$ is less than the inner diameter of production string 35 in such embodiments, cylindrical surface 132*d* may periodically contact or bump into production string 35, but there is an annulus or gap radially positioned between intermediate sleeve 130 and production string 35. Although annular grooves 134 may induce a turbulent zone between intermediate sleeve 130 and production string 35 that restricts fluid flow therebetween, the annulus or gaps radially positioned between intermediate sleeve 130 and production string 35 may allow fluid flow therebetween. As will be described in more detail below, in such embodiments where diameter $D_{132d}$ is less than diameter $D_{122c}$ (and hence less than the inner diameter of production string 35), the durability and operating lifetime of intermediate sleeve 130 is enhanced due to reduced frictional contact with production string 35 and associated wear.

Grooves 134 also offer the potential to reduce the likelihood of intermediate sleeve 130 getting hung up in production tubing 35. In particular, grooves 134 provide a space to accommodate any solids (e.g., sand, scale, etc.) in the wellbore 21, which may otherwise become lodged between surface 132*d* and production string 35, thereby increasing friction between intermediate sleeve 130 and production string 35.

Referring again to FIGS. 3-5, ball 140 has a smooth, spherical outer surface sized and shaped to mate and slidingly engage seating surface 131*e* of intermediate sleeve 130. As previously described, outer radius $R_{140}$ of ball is substantially the same or slightly less than radius $R_{131e}$. By matching the radius of curvature of ball 140 and seating surface 131*e*, a static seal is formed therebetween when ball 140 is fully seated against surface 131*e*.

As previously described, sleeves 120, 130, and ball 140 have a nested arrangement shown in FIG. 5 and a divided arrangement shown in FIG. 4. In the divided arrangement, fluids within production string 35 can bypass sleeve 120, sleeve 130, and ball 140. In particular, fluids in production string 35 can flow through throughbores 123, 133, and around ball 140 (i.e., between ball 140 and string 35). In embodiments where outer diameter $D_{132d}$ of intermediate sleeve 130 is less than outer diameter $D_{122c}$ of sealing sleeve 120, fluids can also flow around intermediate sleeve 130 between sleeve 130 and string 35. As a result, in the divided arrangement, sealing sleeve 120, intermediate sleeve 130, and ball 140 can each fall freely through fluids in production string 35 without shutting in wellbore 21 or production string 35. However, in the nested arrangement, ball 140 is fully seated in receptacle 136 against seating surface 131*e*, and stabbing member 138 of intermediate sleeve 130 is fully seated in receptacle 126 of sealing sleeve 120 against seating surface 121*f*. Consequently, fluids in production string 35 are restricted and/or prevented from bypassing plunger piston assembly 110. In particular, fluids cannot pass through throughbores 123, 133 because ball 140 blocks flow therethrough, and fluids cannot pass between piston assembly 110 and production string 35 because sealing sleeve 120, and in some embodiments intermediate sleeve 130, sealingly engage production string 35.

As will be described in more detail below, sealing sleeve 120, intermediate sleeve 130, and ball 140 are dropped from lubricator 160 and fall independently (i.e., in the divided arrangement) through production string 35 and any fluids therein to lower bumper 150. At lower bumper 150, sealing sleeve 120, intermediate sleeve 130, and ball 140 unite (i.e., ball 140 becomes fully seated in receptacle 136 against seating surface 131*e* and stabbing member 138 becomes fully seated in receptacle 126 against seating surface 121*f*), thereby restricting and/or preventing fluids in string 35 from bypassing plunger piston assembly 110. With piston assembly 110 in the nested arrangement, the pressure within string 35 below piston assembly 110 increases as formation fluids migrate from formation 25 into wellbore 21 and production string 35. When the pressure below piston assembly 110 is sufficient (i.e., the pressure differential across piston assembly 110 is sufficient), piston assembly 110 (in the nested arrangement) is pushed upward through production string 35. The pressure differential across piston assembly 110 maintains piston assembly 110 in the nested arrangement as it ascends through production string 35. Since fluids cannot bypass piston assembly 110 as it ascends in the nested arrangement, any fluids in string 35 above piston assembly 110 (e.g., hydrocarbon liquids, hydrocarbon gases, water, etc.) are pushed by piston assembly 110 to the surface 28. The fluids pushed to the surface 28 are produced through lubricator 160 and/or tree 40. It should be appreciated that the produced fluids include the accumulated liquids 27 in production string 35 disposed above piston assembly 110 when it achieves the nested arrangement at lower bumper 150 proximal lower end 35*a* of production string 35, and thus, this process effectively removes such liquid from production string 35. At the surface 28, ball 140 is separated from sleeves 120, 130 with striking rod 180 and falls back down production string 35, and after a delay, sleeves 120, 130 are dropped and fall down production string 35, thereby allowing the process to repeat.

Referring again to FIG. 2, lower bumper 150 is mounted in production string 35 proximal lower end 35*b*. In general, lower bumper 150 can be mounted in string 35 by any suitable means known in the art including, without limitation, a sub mounted between adjacent joints of string 35, a seating nipple, etc. In this embodiment, lower bumper 150 includes a base 151 fixably mounted to string 35, an elongate helical spring 152 coupled to the top of base 151, and an anvil 153 attached to the upper end of spring 152.

Referring still to FIG. 2, lubricator 160 includes a tubular housing 161, a radial conduit or flowline 162 extending laterally from housing 161, and a bypass conduit or flowline 163 extending from housing 161 to flowline 162. Housing 161 has a first or upper end 161*a*, a second or lower end 161*b* threadably coupled to upper end 40*a* of tree 40, and a cylindrical throughbore 164 extending between ends 161*a*, 161*b*. Flowlines 162, 163 are in fluid communication with throughbore 164. Each flowline 162, 163 includes a valve 165 that controls the flow of fluids therethrough.

Housing 161 and throughbore 164 therein are coaxially aligned with vertical bore 41 of tree 40 and production string 35 (i.e., throughbore 164 has a central axis aligned with axis 36 of string 35 and the central axis of bore 41) and is in fluid communication with vertical bore 41 and production string 35. In addition, diameter of throughbore 164 is substantially the same as the diameter of vertical bore 41 and the inner diameter of production string 35. Consequently, there is a generally contiguous, smooth transition between throughbore 164, bore 41, and production string 35, which enables sleeves 120, 130 and ball 140 (i.e., the individual components of plunger piston assembly 110) to move freely through and between production string 35, tree 40, and housing 161 without restriction. In other words, there are no shoulders or obstructions at the transitions between throughbore 164, vertical bore 41, and production string 35 that can cause sealing sleeve 120, intermediate sleeve 130, or ball 140 to get hung up.

A cap 166 is threaded onto upper end 161*a* of housing 161, thereby closing throughbore 164 at upper end 161*a*. Upper bumper 170 is attached to the inside of cap 166 and extends vertically downward into housing 161. In this embodiment, upper bumper 170 includes an elongate helical spring 171 and an anvil 172 attached to the lower end of spring 171. Striking rod 180 is coupled to anvil 172 and extends vertically downward therefrom through throughbore 164. Spring 171, anvil 172, and striking rod 180 are coaxially aligned and concentrically disposed within housing 161. Rod 180 has a uniform outer diameter less than the minimum inner diameters $D_{121d}$, $D_{131d}$ of sleeves 120, 130, respectively, and rod 180 has an axial length greater than length $L_{120\text{-}130}$. Anvil 172 has an outer diameter greater than the inner diameter of sealing sleeve 120 at upper end 120*a*.

Referring still to FIG. 2, catcher 190 is coupled to housing 161 and functions to releasably engage and hold sealing sleeve 120 and intermediate sleeve 130 at lubricator 160. In this embodiment, catcher 190 includes an outer cylinder 191 and a piston 192 moveably disposed in cylinder 191. Piston 192 divides cylinder 191 into a first chamber 191*a* and a second chamber 192*b* on the opposite side of piston 192 as first chamber 191*a*. A spring 193 is disposed in chamber 192 between piston 192 and housing 161.

Catcher 190 also includes an elongate detent or pin 195 extending from piston 192 through chamber 191*b*. A port 167 is provided in housing 161 to allow pin 195 to pass therethrough into and out of throughbore 164 of lubricator 160. Thus, pin 195 may be described as having a retracted or withdrawn position removed from throughbore 164 and an extended or advanced position extending through port 167 into throughbore 164. An air line 194 is coupled to chamber 191*a* and is configured to increase or decrease the pressure within chamber 191*a*.

Pin 195 is transitioned between the withdrawn and extended positions by the pressure differential across piston 192 as controlled by air line 194 and the biasing force applied to piston 192 by spring 193. In particular, spring 193 is compressed between piston 192 and housing 161, and thus, biases pin 195 to the withdrawn position. However, by increasing the pressure within chamber 191*a* with air line 194, the pressure differential across piston 192 can be increased to overcome the biasing force of spring 195, thereby transitioning pin 195 from the withdrawn position to the extended position. Pin 195 can be transitioned back to the withdrawn position by bleeding pressure from chamber 191*a* via air line 194 until the pressure differential across piston 192 is overcome by the biasing force of spring 195.

As will be described in more detail below, pin 195 is sized and shaped to positively engage groove 134*a* of intermediate sleeve 130, thereby holding intermediate sleeve 130 and sealing sleeve 120 disposed atop sleeve 130 at lubricator 160 for a period of time. Then, pin 195 is transitioned to the withdrawn position to release intermediate sleeve 130 and allow sleeves 120, 130 to fall down through production string 35.

As shown in FIG. 3, in this embodiment, each sleeve 120, 130 includes a plurality of axially spaced annular grooves 124, 134, respectively. Each groove 124, 134 is generally oriented or lies along a plane perpendicular to central axes 125, 135. However, in other embodiments, the grooves on the outer surface of the sealing sleeve (e.g., grooves 124 of sleeve 120) and/or the grooves on the outer surface of the intermediate sleeve (e.g., grooves 134 of sleeve 130) comprise a plurality of uniformly circumferentially-spaced helical grooves.

Figure 7A:
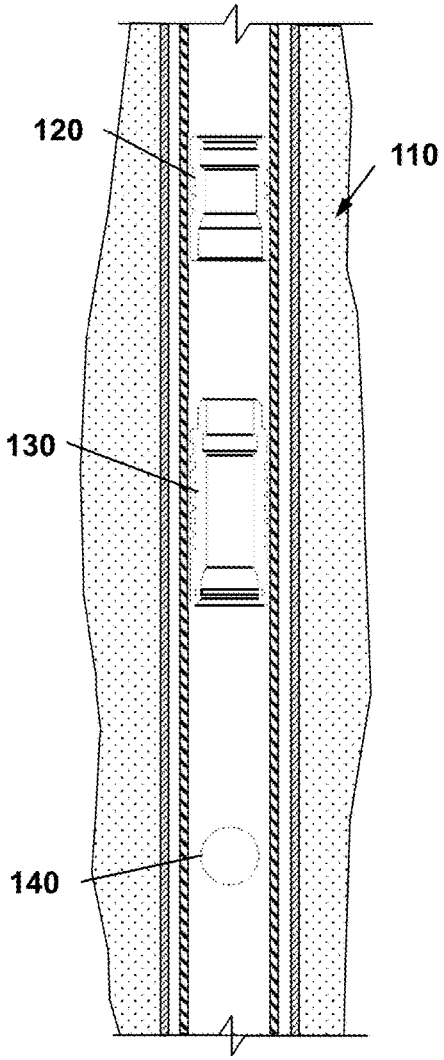
FIGS. 7A-7K are sequential schematic, partial cross-sectional views of the plunger lift system of FIG. 2 illustrating an embodiment of a method for removing liquids from the production system of FIG. 1.
Figure 7B:
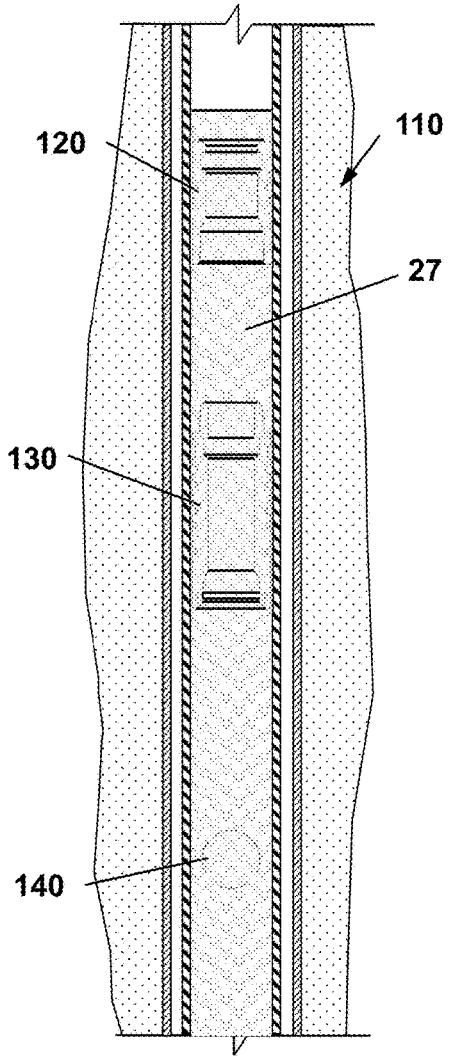
Figure 7C:
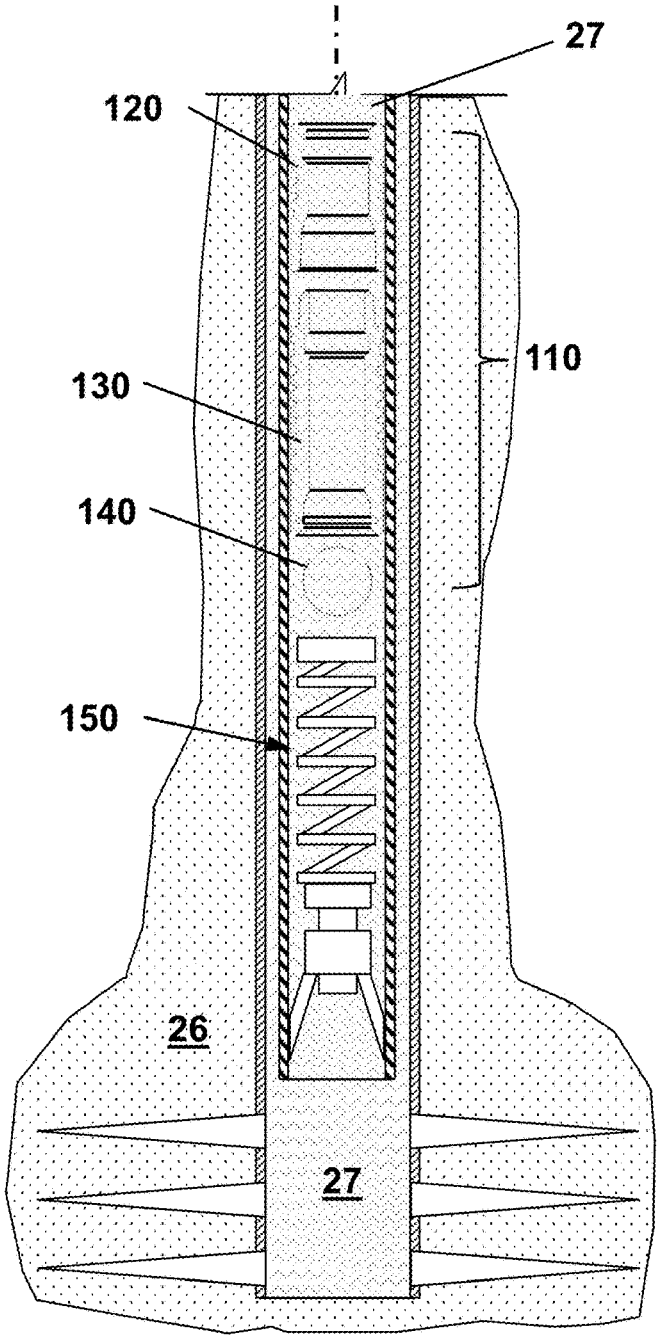

Referring now to FIGS. 7A-7K, the operation of plunger lift system 100 to remove liquids 27 from wellbore 21 and production string 35 will now be described. In FIGS. 7A-7C, plunger piston assembly 110 is shown falling through production string 35 and fluids (gases and liquids) in production string 35 in the divided arrangement; in FIGS. 7C and 7D, piston assembly 110 is shown transitioning from the divided arrangement to the nested arrangement at lower bumper 150; in FIGS. 7E-7G, piston assembly 110 is shown ascending through production string 35 to tree 40 and lubricator 160 in the nested arrangement, pushing fluids in production string 35 disposed above piston assembly 110 to the surface 28; in FIGS. 7H and 7I, sleeves 120, 130 of piston assembly 110 is shown sliding onto striking rod 180 and ball 140 is shown being dislodged from intermediate sleeve 130 with rod 180, thereby transitioning piston assembly 110 to the divided arrangement; in FIG. 7J, sleeves 120, 130 are shown being temporarily held within lubricator 160 by catcher 190 as ball 140 falls down through tree 40 into production string 35; and in FIG. 7K, sleeves 120, 130 are shown being released by catcher 190 and falling down through tree into production string 35.

Referring first to FIGS. 7A and 7B, sealing sleeve 120, intermediate sleeve 130, and ball 140 are dropped from the surface 28 and fall down through production string 35 in the divided arrangement. As previously described, any fluids in production string 35, including accumulated liquids 27, are free to bypass sleeves 120, 130, and ball 140 as they fall through production string 35 in the divided arrangement. As a result, wellbore 21 and production string 35 do not need to be shut in with production tree 40 to allow any of sleeves 120, 130, and ball 140 to fall under gravity through production string 35 and any fluids therein. By reducing and/or eliminating the need to shut in wellbore 21 and string 35, plunger lift system 100 offers the potential to reduce the risk of inadvertently killing wellbore 21. Separation of intermediate sleeve 130 and ball 140 is generally maintained as these components fall through production string 35 as ball 140 is dropped in advance of sleeve 130 and generally falls faster than sleeve 130. Sleeves 120, 130 may fall separately or come together depending on a variety of factors including the relative weights and dimensions of sleeves 120, 130. For example, in embodiments where diameter $D_{131d}$ of sleeve 130 is less than diameter $D_{121d}$ of sleeve 120 and outer diameters $D_{122e}$, $D_{132d}$ are the same, sleeve 120 may catch up with intermediate sleeve 130. However, even if sleeve 120 catches up to sleeve 130, sleeves 120, 130 will generally separate when moving through tights spots in production string 35.

Figure 7D:
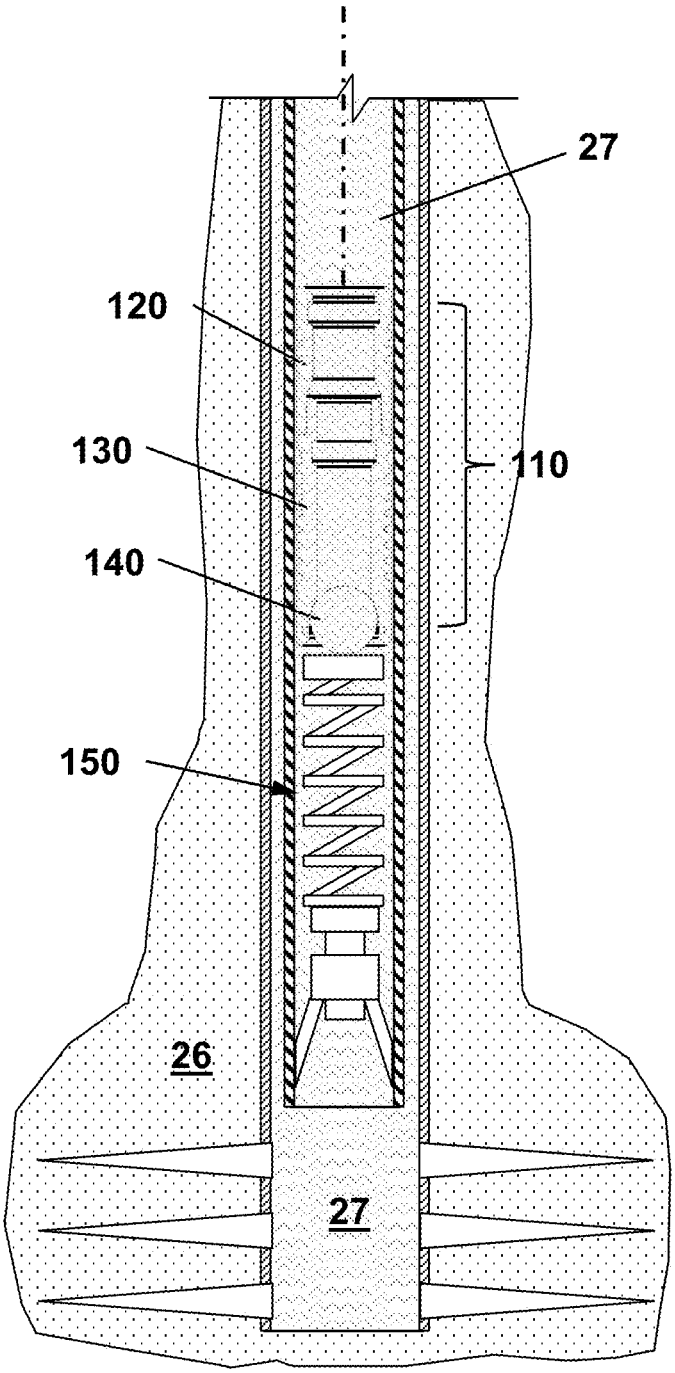

Moving now to FIGS. 7C and 7D, sleeves 120, 130 and ball 140 fall through production string 35 to lower bumper 150, where sleeves 120, 130 and ball 140 transition to the nested arrangement shown in FIG. 7D. In particular, ball 140 impacts anvil 153, then intermediate sleeve 130 receives ball 140 into receptacle 136, ball 140 urges snap ring 137 open to allow ball 140 to pass therethrough and seat against surface 131*e*, and then sealing sleeve 120 receives stabbing member 138 of intermediate sleeve 130 into receptacle 126 against seating surface 121*f*. Spring 152 functions as a shock absorber as ball 140 impacts spring 152, sleeve 130 impacts ball 140, and sleeve 120 impacts sleeve 130. In other words, spring 152 cushions the impacts and minimizes the potential for damage of sleeves 120, 130 and ball 140. Once piston assembly 110 transitions to the nested arrangement, fluids in production string 35 are restricted and/or prevented from bypassing plunger piston assembly 110 as previously described.

Figure 7E:
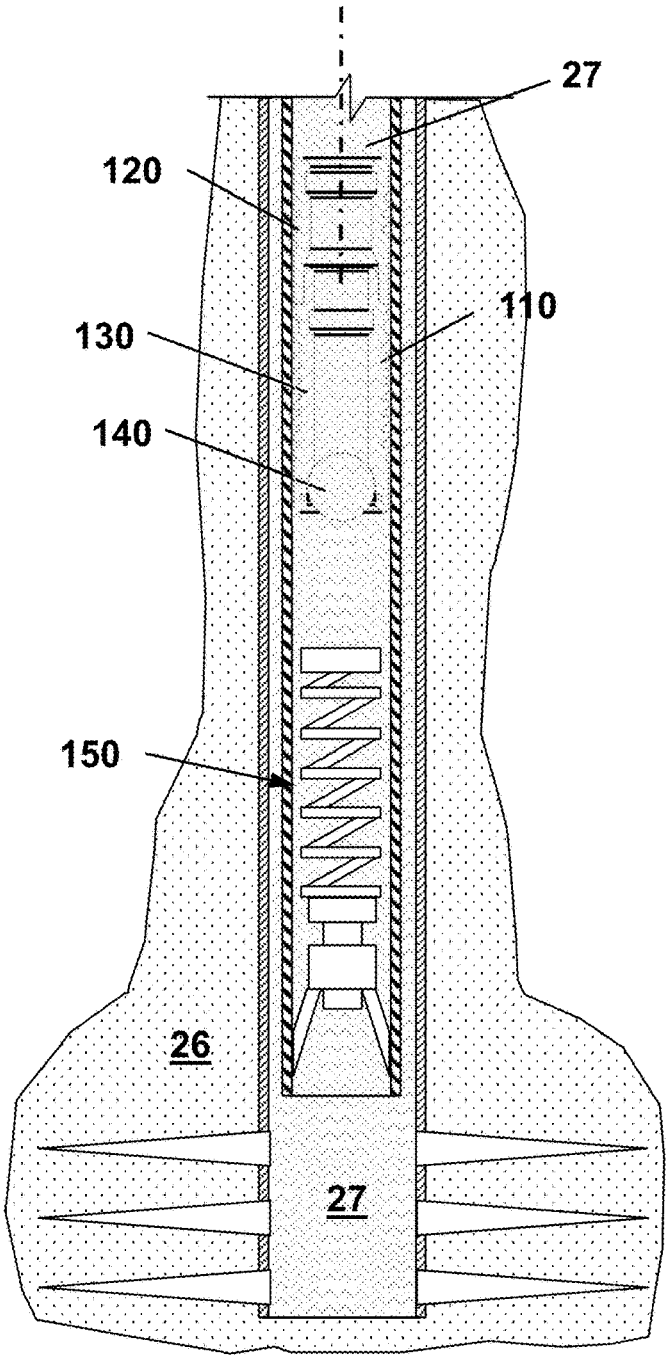

Referring now to FIGS. 7D and 7E, ball 140 sealingly engages surface 131*e* and stabbing member 138 sealingly engages seating surface 121*f* in the nested arrangement. The pressure in wellbore 21, annulus 33, and the portion of production string 35 below piston assembly 110 gradually increases due to the influx of formation fluids from production zone 26. Such fluids cannot bypass plunger piston assembly 110 due to sealing engagement of assembly 110 with production string 35 and ball 140 blocking throughbores 123, 133. When the pressure in production string 35 below piston assembly 110 has sufficiently increased, piston assembly 110 is pushed upward through production string 35. The pressure differential across piston assembly 110 (pressure below piston assembly 110 is greater than the pressure above piston assembly 110) in combination with snap ring 137 function to maintain ball 140 within receptacle 136 against surface 131*e* and prevent ball 140 from inadvertently falling out of receptacle 136 during ascent of piston assembly 110.

Figure 7F:
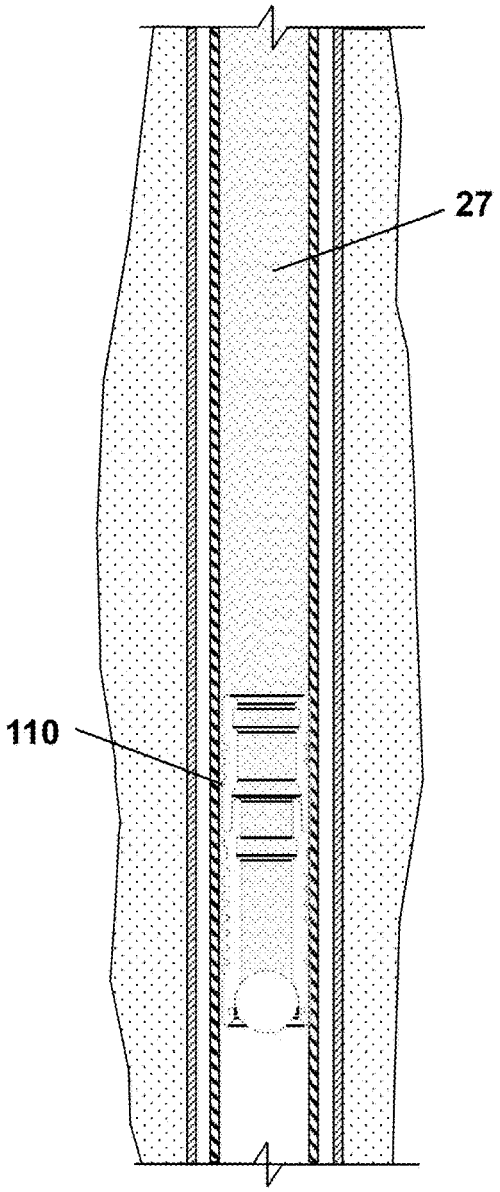
Figure 7G:
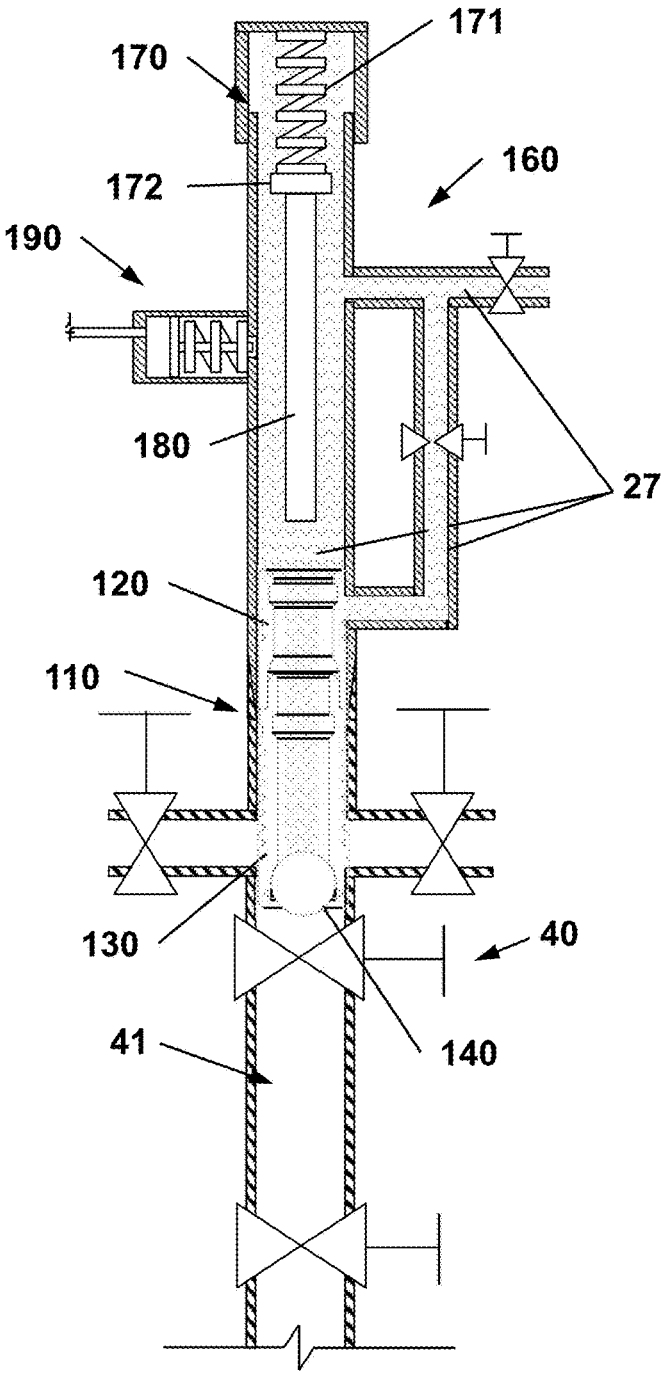

Moving now to FIGS. 7F and 7G, since piston assembly 110 is in the nested arrangement, fluids in production string 35 above piston assembly 110, including liquids 27, cannot bypass piston assembly 110 (due to sealing engagement of assembly 110 with production string 35 and ball 140 blocking throughbores 123, 133), and thus, are pushed to the surface 28 where they are produced through production tree 40 and/or lubricator 160. As piston assembly 110 ascends through production string 35 and into tree 40, piston assembly 110 is maintained in the nested arrangement by the pressure differential thereacross (i.e., pressure below piston assembly 110 is greater than the pressure above piston assembly 110).

Figure 7H:
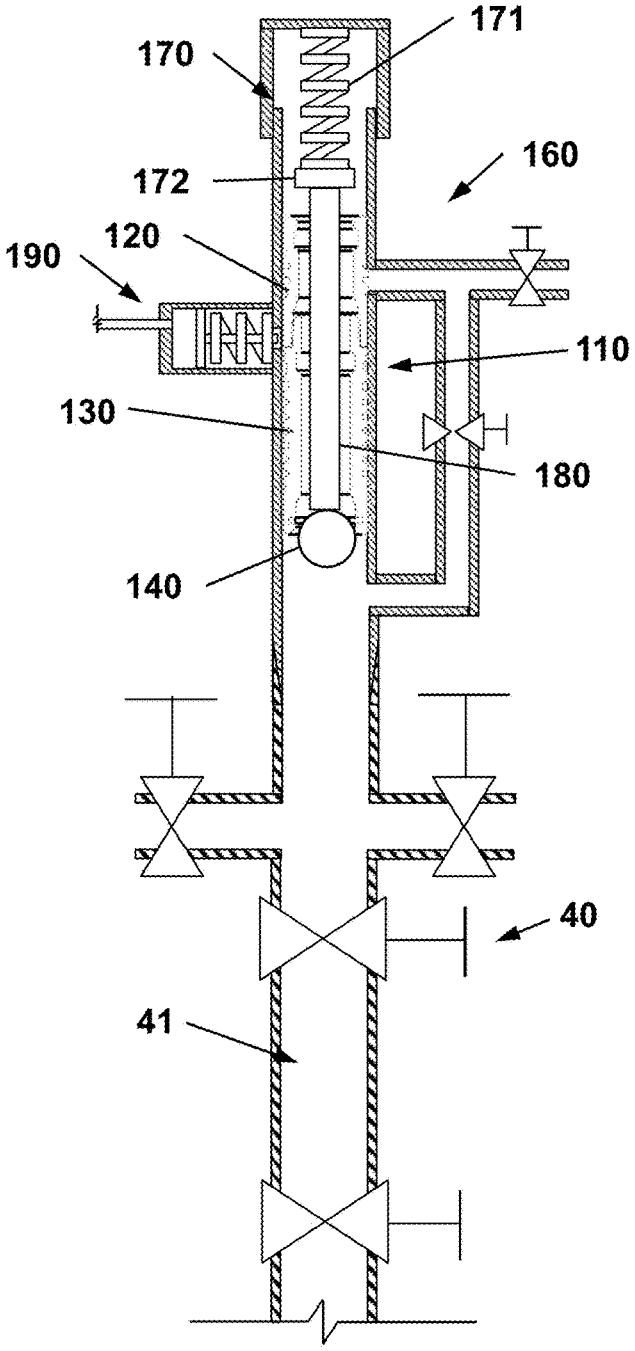
Figure 7I:
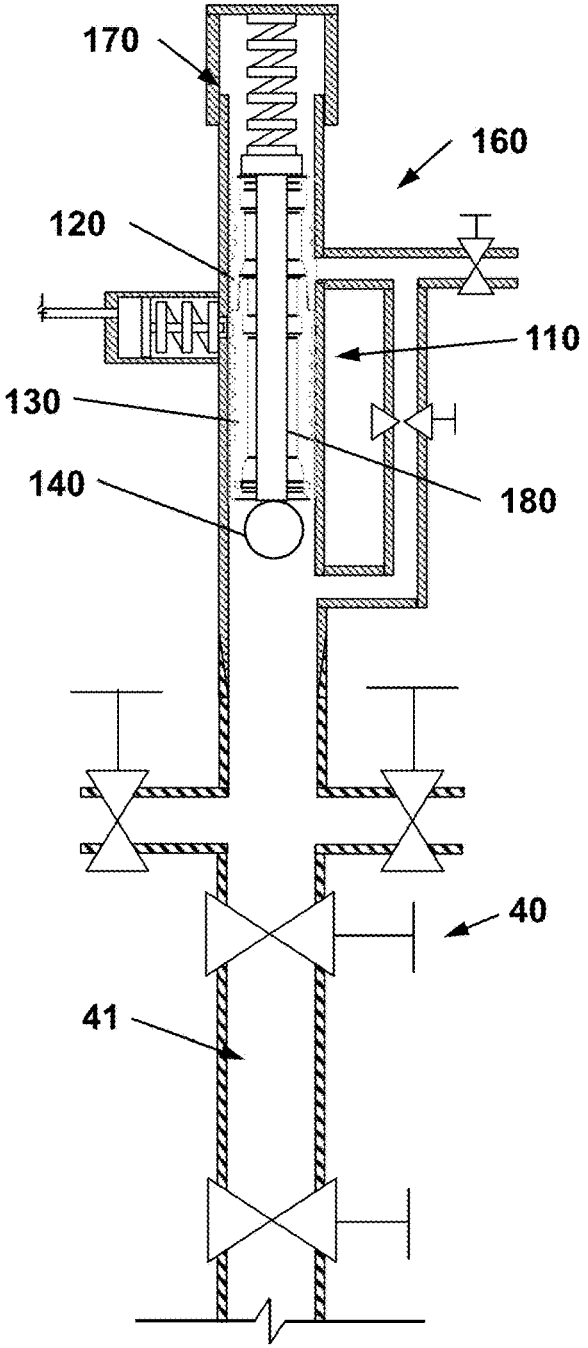

Referring now to FIGS. 7G-7I, piston assembly 110 ascends through bore 41 of production tree 40 to lubricator 160. Sleeves 120, 130 are slidingly received on striking rod 180 and slide along rod 180 to anvil 172 as shown in FIGS. 7H and 7I. Upper sleeve 120 impacts anvil 172, thereby stopping the ascent of sleeves 120, 130. Rod 180 has a length greater than the length $L_{120\text{-}130}$, and thus, as sleeves 120, 130 slide along rod 180 to anvil 172, the lower end of rod 180 impacts ball 140 and dislodges ball 140 from intermediate sleeve 130 as shown in FIG. 71. The impact force applied by rod 180 to ball 140 is sufficient to enable ball 140 to urge snap ring 137 open and pass therethrough. Spring 171 functions as a shock absorber as sealing sleeve 120 impacts anvil 172, as intermediate sleeve 130 is forced against sealing sleeve 120 upon impact of sleeve 120 with anvil 172, and as ball 140 impacts the lower end of rod 180.

In other words, spring 171 cushions the impacts and minimizes the potential for damage of sleeves 120, 130 and ball 140.

Figure 7J:
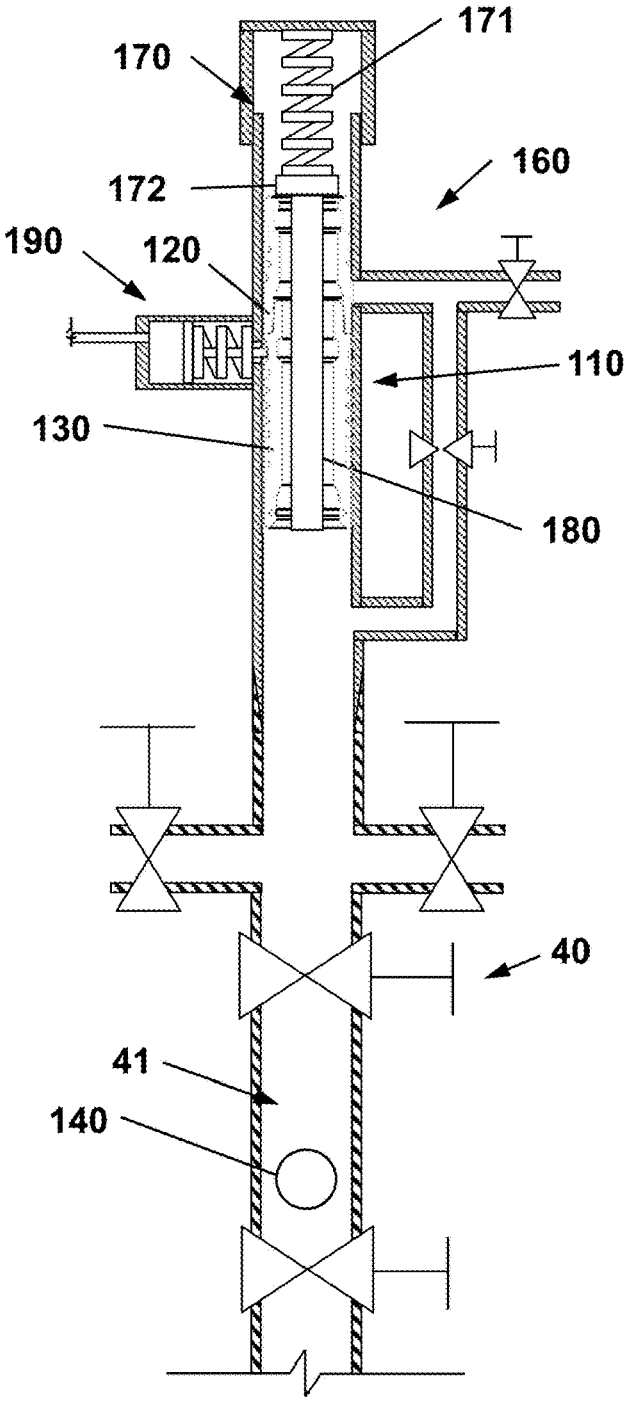

Moving now to FIG. 7J, once dislodged from intermediate sleeve 130, ball 140 is allowed to fall through tree 40 and production string 35 back to lower bumper 150. However, a control system (not shown) senses the arrival of sleeves 120, 130. In general, the control system can detect the arrival of sleeves 120, 130 using any devices or methods known in the art including, without limitation, flow rate sensors, electromagnetic sensors, vibration sensors, etc. Upon detecting that sleeves 120, 130 are disposed on rod 180 with sealing sleeve 120 seated against anvil 172, catcher 190 is actuated by the control system to move pin 195 from the withdrawn position to the extended position engaging groove 134*a* of intermediate sleeve 130 as shown in FIG. 7J. As noted above, the length $L_{120}$ of sealing sleeve 120 may be influenced by the location of a catcher 190. More specifically, in embodiments of system 100 that employ catcher 190, the length L120 of sealing sleeve 120 is selected such that groove 134*a* of intermediate sleeve 130 is aligned with pin 195 of catcher 190 when sleeves 120, 130 are disposed about rod 180 with sleeve 120 axially abutting anvil 172.

Engagement of pin 195 and groove 134*a* holds sleeves 120, 130 in place on rod 180 (i.e., prevents sleeves 120, 130 from falling through tree 40 into production string 35). Sleeves 120, 130 are held by catcher 190 for a specific amount of time, which is set by the operator using the control system. This amount of time may be varied depending on the operation of plunger piston 110 (e.g., how well it is tripping). However, once the well is optimized, the delay between ball 140 being dislodged from intermediate sleeve 130 and the release of sleeves 120, 130 by catcher 190 can be fairly consistent.

Figure 7K:
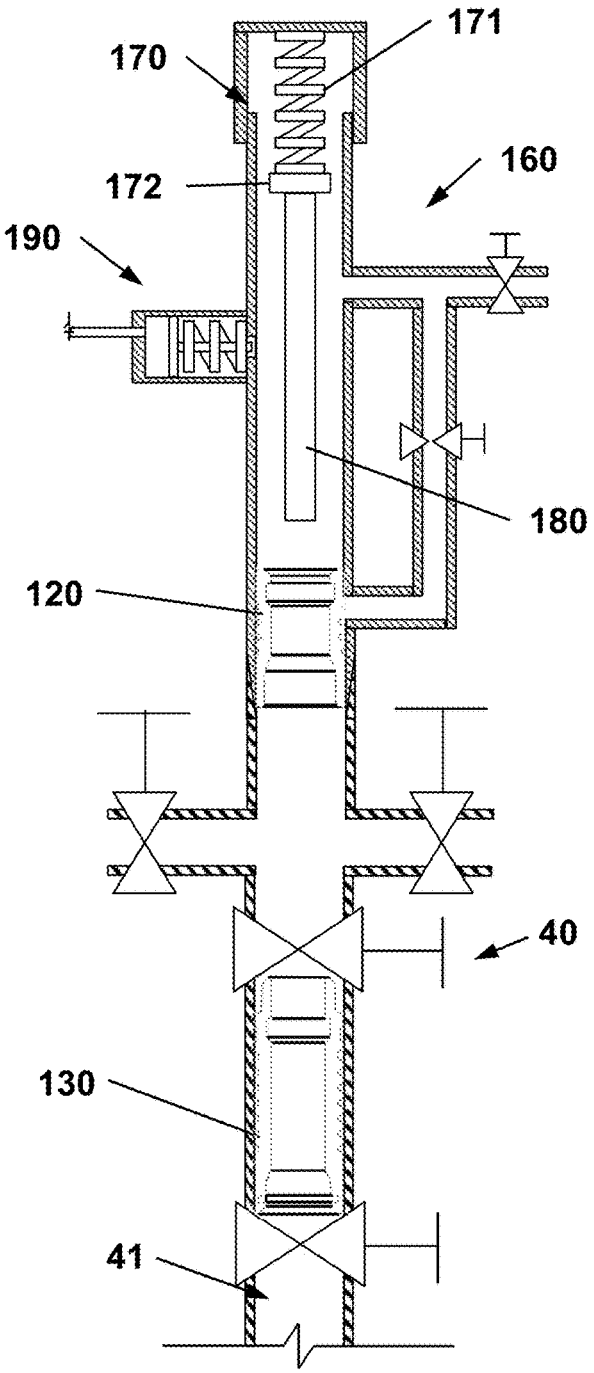

Referring now to FIG. 7K, upon release of intermediate sleeve 130 by catcher 190 (i.e. once pin 195 is transitioned to the withdrawn position), sleeves 120, 130 slide downward off rod 180 through tree 40 and production string 35 as previously described. This process is generally repeated in the manner described to continuously remove accumulated liquids 27 from wellbore 21 and production string 35.

As previously described, since fluids in production string 35 are generally able to bypass sealing sleeve 120, intermediate sleeve 130, and ball 140 as each falls independently through production string 35, embodiments of plunger piston assembly 110 described herein can usually be employed to remove accumulated liquids 27 without shutting in the wellbore 21 or production string 35. This is generally the case with relatively weak wells, which is particular advantageous because relatively weak wells are particularly susceptible to being inadvertently killed if shut in. In relatively strong wells, it may be desirable to temporarily shut in the well when dropping sleeves 120, 130 and ball 140 in the divided arrangement since the production flow rate of a relatively strong well may be sufficient to slow or stop the independent descent of one or more of sealing sleeve 120, intermediate sleeve 130, and ball 140. However, unlike a relatively weak well, there is relatively little risk of inadvertently killing a relatively strong well by temporarily shutting it in.

Embodiments of plunger piston assembly 110 also offer the potential for (a) reduced likelihood of getting hung up within production string 35, and (b) enhanced operating lifetime and reduced operating costs as compared to many conventional free pistons used in plunger lift systems. More specifically, the length $L_{120}$ of sealing sleeve 120 and the length $L_{130}$ of intermediate sleeve 130 are each less than the length of many conventional free pistons used in plunger lift systems, and thus, the likelihood of hang up of sleeve 120 and sleeve 130 is less than that of such conventional free pistons. This enables the maximum outer diameter $D_{121c}$ of sealing sleeve 120 to be increased as compared to such conventional free pistons without a significant increase in the likelihood of a hang up. It should be appreciated that an increased maximum outer diameter $D_{121c}$ (as compared to many conventional free pistons), offers the potential for an improved dynamic seal between sleeve 120 and production string 35, and improved durability as sealing sleeve 120 can accommodate greater wear before it must be replaced. For example, a conventional free piston for 2⅜ in. production tubing with a 1.995 in. inner diameter will typically have a maximum outer diameter of 1.90 in., and will usually be replaced when the maximum outer diameter decreases to about 1.86 in. to 1.87 in. due to frictional wear. However, in an exemplary embodiment of piston assembly 110 described herein for use with 2⅜ in. production string 35 with an inner diameter of 1.995 in., the maximum outer diameter $D_{121c}$ of sealing sleeve 120 is greater than 1.90 in., such as 1.91 in. to 1.92 in., which enables sealing sleeve 120 and piston assembly 110 to be operate for a longer period of time (a greater number of cycles) before the maximum outer diameter $D_{121c}$ of sealing sleeve 120 is reduced to about 1.86 in. to 1.87 in. due to frictional wear.

Moreover, in embodiments where the maximum outer diameter $D_{122c}$ of sealing sleeve 120 is greater than the maximum outer diameter $D_{132d}$ of intermediate sleeve 130, sealing sleeve 120 can be replaced when it is sufficiently worn without necessitating the replacement of intermediate sleeve 130. In particular, in embodiments where the maximum outer diameter $D_{122c}$ of sealing sleeve 120 is greater than the maximum outer diameter $D_{132d}$, sealing sleeve 120 will wear to a greater rate and to a greater extent than intermediate sleeve 130 since an annulus or gap is provided between intermediate sleeve 130 and production string 35. As a result, the operating lifetime of intermediate sleeve 130 is enhanced. The length $L_{120}$ of sealing sleeve 120 is less than most conventional free pistons for use with similarly sized production strings, and thus, the material costs associated with replacing sealing sleeve 120 is generally less than the material costs associated with replace such conventional free pistons. Accordingly, embodiments of piston assembly 110 described herein also offer the potential for reduced operating costs as compared to many conventional free pistons.

Figure 8:
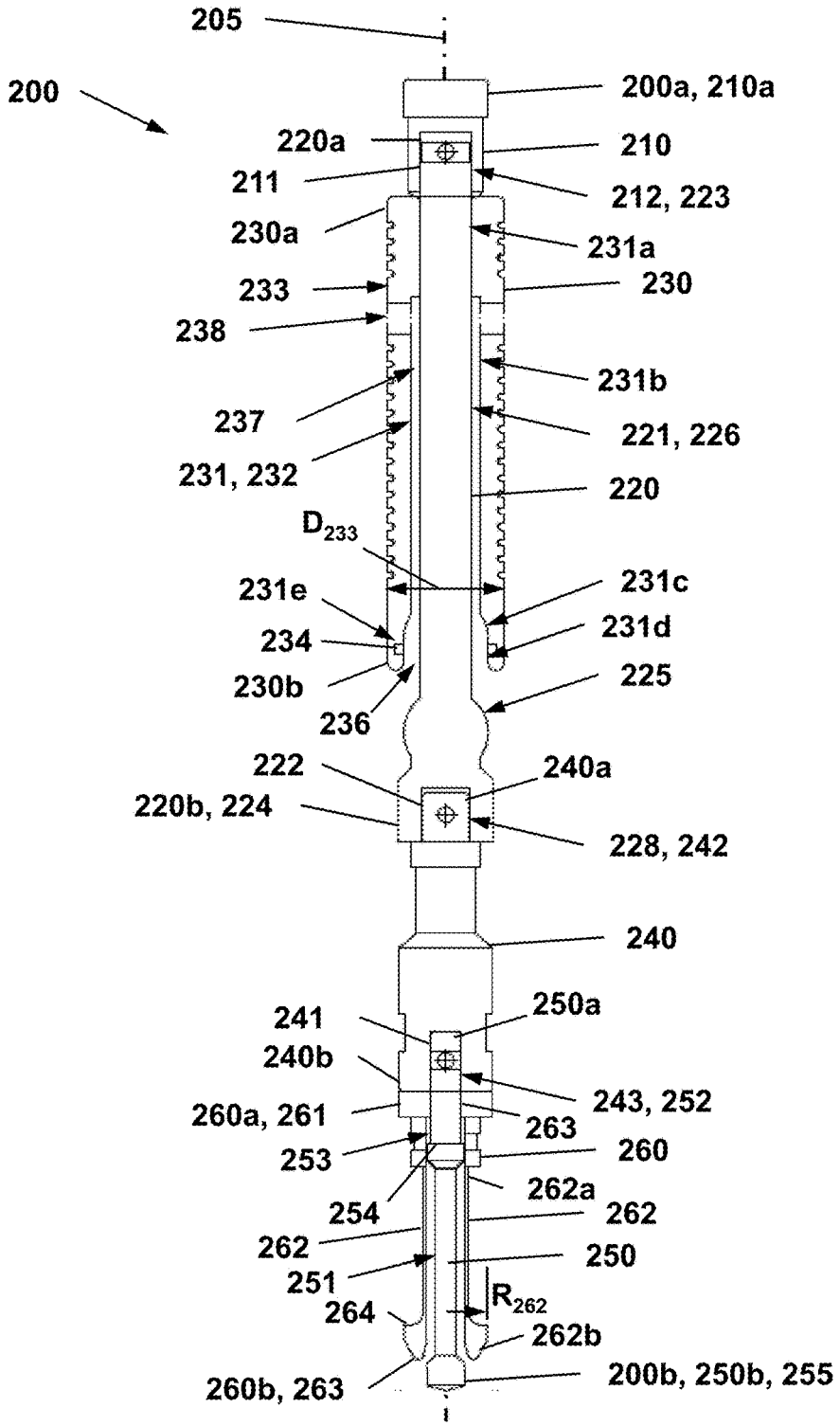
FIG. 8 is a partial cross-sectional view of an embodiment of a tool in accordance with the principles described herein for retrieving the plunger piston assembly of FIG. 2.

Referring now to FIG. 8, an embodiment of a tool 200 for retrieving a plunger piston or sleeve (e.g., sleeve 120 and/or sleeve 130) is shown. For example, in the event sleeve 120 and/or sleeve 130 become stuck downhole in production string 35, tool 200 can be used to retrieve sleeve 120 and/or sleeve 130. Although tool 200 is described within the context of retrieving sleeve 120 and/or sleeve 130 described herein, in general, tool 200 can be used to retrieve any type of plunger piston, and thus, the use of tool 200 is not limited to use with plunger piston assembly 110 or any components thereof.

Tool 200 has a central or longitudinal axis 205, a first or upper end 200*a*, and a second or lower end 200*b*. Moving axially from upper end 200*a* to lower end 200*b*, in this embodiment, tool 200 includes an end cap 210 at upper end 200*a*, an elongate center carrier rod 220 fixably attached to end cap 210, an annular sealing sleeve 230 slidably mounted to carrier rod 220, a connection member or body 240 fixably attached to carrier rod 220, an elongate spike or stabbing member 250 fixably attached to body 240, and a collet assembly 260 slidably mounted to stabbing member 250. Cap 210, carrier rod 220, sealing sleeve 230, body 240, stabbing member 250, and collet assembly 260 are coaxially aligned, each having a central or longitudinal axis coincident with axis 205.

Referring still to FIG. 8, end cap 210 is disposed at upper end 200*a* and includes a counterbore or receptacle 211 at its lower end. Receptacle 211 includes internal threads 212. Carrier rod 220 has a first or upper end 220*a*, a second or lower end 220*b* opposite end 220*a*, a radially outer surface 221 extending axially between ends 220*a*, 220*b*, and a counterbore or receptacle 222 extending axially from lower end 220*b*. Outer surface 221 includes external threads 223 at upper end 220*a*, a plurality of circumferentially-spaced wrench flats 224 at lower end 220*b*, an enlarged spherical sealing surface 225 adjacent wrench flats 224, and a cylindrical surface 226 extending between sealing surface 225 and external threads 223. Upper end 220*a* of carrier rod 220 is threaded into receptacle 211 of end cap 210 via mating threads 212, 223. A set screw is threaded radially through end cap 210 and into engagement with upper end 220*b* disposed therein to prevent end cap 210 and carrier rod 220 from inadvertently unthreading. Counterbore 222 includes internal threads 228.

Sealing sleeve 230 has a first or upper end 230*a*, a second or lower end 230*b*, a radially inner surface 231 defining a through bore or passage 232 extending axially from upper end 230*a* to lower end 230*b*, and a radially outer surface 233 extending axially between ends 230*a*, 230*b*. Carrier rod 220 extends coaxially through passage 232.

Inner surface 231 includes a first cylindrical surface 231*a* extending from upper end 230*a*, a second cylindrical surface 231*b* axially adjacent surface 231*a*, a hemispherical seating surface 231*c* proximal lower end 230*b*, and a frustoconical guide surface 231*d* extending from lower end 230*b* to seating surface 231*c*. Seating surface 231*c* and guide surface 231*d* define a receptacle 236 at lower end 230*b* of sealing sleeve 230 that receives spherical sealing surface 225. In particular, frustoconical surface 231*d* guides sealing surface 225 into sealing engagement with seating surface 231*c*. In other words, hemispherical seating surface 231*c* is disposed at substantial the same radius as sealing surface 225, and thus, surfaces 231*c*, 225 are sized to mate and sealingly engage.

An annular groove 231*e* is provided along guide surface 231*d*, and an annular snap ring 234 is seated in groove 231*e*. Snap ring 234 is substantially the same as snap ring 137 previously described and functions in a similar manner to retain sealing surface 225 in sealing engagement with seating surface 231*c*.

Cylindrical surface 231*a* is disposed at an inner diameter that is less than cylindrical surface 231*b*, and thus, an annular downward facing planar shoulder extends radially therebetween. In addition, the inner diameter of cylindrical surface 231*a* is substantially the same or slightly greater than the outer diameter of cylindrical surface 226 of carrier rod 220. Thus, surfaces 231*a*, 226 slidingly engage, however, surface 231*b* is radially spaced from carrier rod 220. As a result, an annulus 237 is provided between surfaces 231*a*, 226.

Outer surface 233 of sealing sleeve 230 comprises a cylindrical surface including a plurality of axially-spaced annular grooves. The grooves on outer surface 233 are similar to grooves 124, 134 previously described. A plurality of circumferentially-spaced radial ports or bores 238 extend radially from outer surface 233 to inner surface 231 proximal the shoulder between surfaces 231*a*, 231*b*.

The outer surface 233 and grooves therein form a sealing system or arrangement that restricts and/or prevents fluids in production string 35 from passing between the radially outer surface 233 of sleeve 230 and string 35 when tool 200 is deployed to retrieve plunger piston assembly 110. More specifically, outer surface is disposed at an outer diameter $D_{233}$ that defines the maximum outer diameter of sealing sleeve 230, as well as tool 200. Diameter $D_{233}$ is substantially the same or slightly less (~1-6% less) than the inner diameter of production string 35 within which it is disposed to retrieve plunger piston assembly 110. Thus, outer surface 233 slidingly engages production string 35 and forms a dynamic seal with production string 35 as sealing sleeve 230 moves therethrough. The annular grooves along the outer surface 233 reduce drag and friction between sealing sleeve 230 and production string 35, while simultaneously facilitating a turbulent zone between sealing sleeve 230 and production string 35 that restricts fluid flow therebetween. The grooves also offer the potential to reduce the likelihood of sealing sleeve 230 getting hung up in production tubing 35. In particular, the grooves along outer surface 233 provide a space to accommodate any solids (e.g., sand, scale, etc.) in the wellbore 21, which may otherwise become lodged between surface 233a and production string 35, thereby increasing friction between sealing sleeve 230 and production string 35.

In embodiments where production string 35 has an inner diameter of 1.995 in. (i.e., production string 35 is 2⅜ in. tubing), outer diameter $D_{233}$ is preferably greater than or equal to 1.80 in. and less than 1.995 in., and more preferably greater than or equal to 1.89 in. and less than or equal 1.91 in.; and in embodiments of where production string 35 has an inner diameter of 2.441 in. (i.e., production string 35 is 2⅞ in. tubing), outer diameter $D_{233}$ is preferably greater than or equal to 2.25 in. and less than 2.441 in., and more preferably greater than or equal to 2.33 in. and less than or equal 2.35 in. In this embodiment, production string 35 has an inner diameter of 1.995 in. and diameter $D_{233}$ is 1.89 in.

Figures 9A, 9B, 9C:
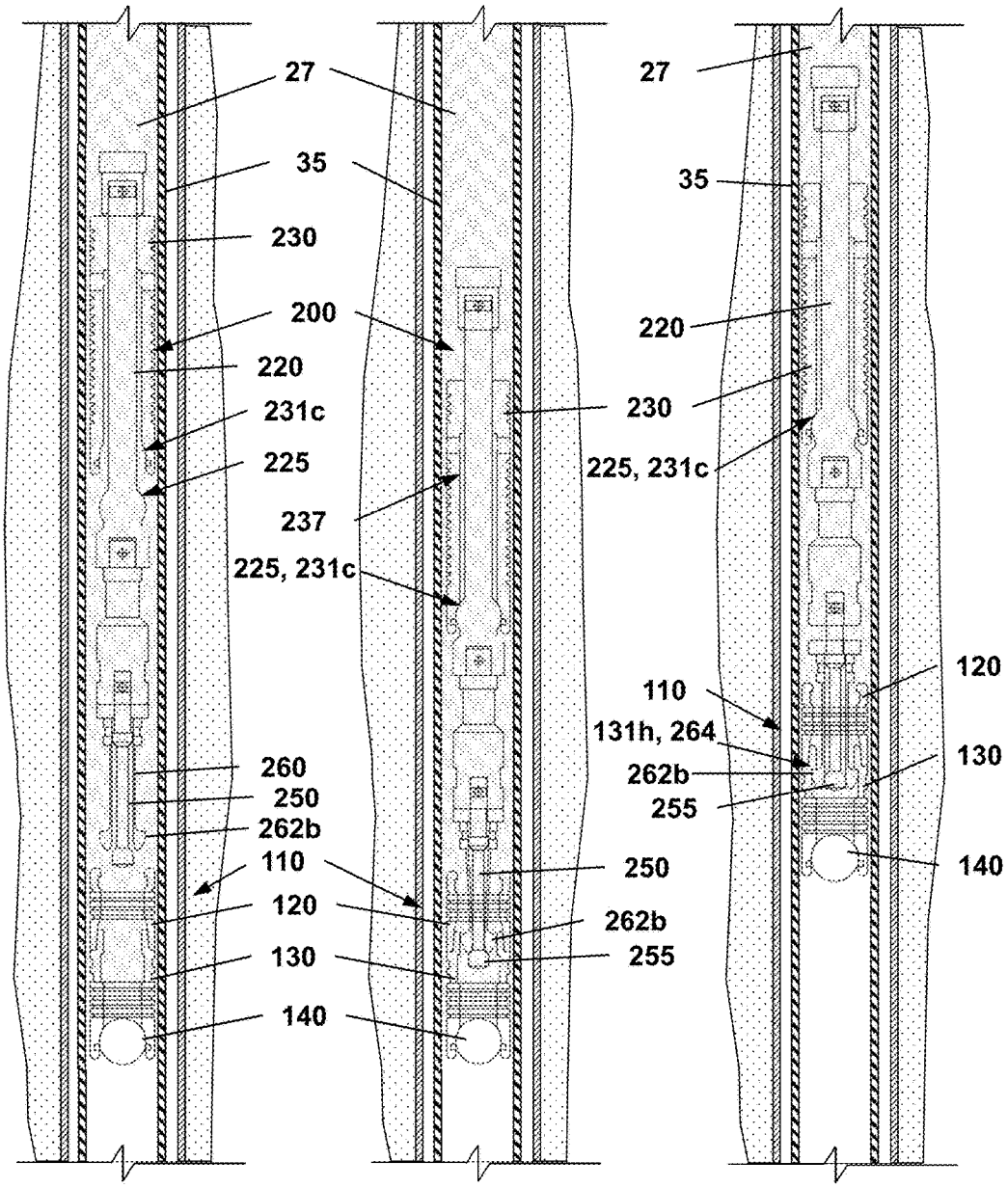
FIGS. 9A-9C are sequential schematic, partial cross-sectional views of the tool of FIG. 8 retrieving the plunger piston assembly of FIG. 2.

As will be described in more detail below, during a retrieval operation, sealing sleeve 230 moves axially along and relative to carrier rod 220. In particular, sealing sleeve 230 has a first or bypass position as shown in FIGS. 8 and 9A with seating surface 231*c* axially-spaced above sealing surface 225, and a second or sealed position shown in FIGS. 9B and 9C with hemispherical seating surface 231*c* in sealing engagement with mating spherical surface 225. During descent of tool 200 within production tubing 35, the fluids in the production tubing 35 in connection with the larger projected cross-sectional area of sealing sleeve 230 maintains sealing sleeve 230 is in the first position. However, upon impact and engagement of the lower end 200*b* of tool 200 with the stuck plunger piston to be retrieved (e.g., sleeve 130 and/or sleeve 120), sealing sleeve 230 transitions to the second position. Subsequently, sealing sleeve 230 is maintained in the second position by snap ring 234 as tool 200 dislodges and lifts the stuck plunger piston to the surface 28. Thus, during ascent of tool 200 within production tubing 35, sealing sleeve 230 is in the second position. When sealing sleeve 230 is in the first position during descent, fluids in production tubing 25 can flow around sealing surface 225 via throughbore 232 at lower end 230*b*, annulus 237, and radial bores 238, thereby bypassing sealing sleeve 230. However, when sealing sleeve 230 is in the second position, sealing engagement of surfaces 225, 231*c* restricts and/or prevents fluids in production tubing 35 from bypassing sealing sleeve 230.

Referring still to FIG. 8, connection member 240 has a first or upper end 240*a*, a second or lower end 240*b*, and a counterbore or receptacle 241 extending axially from lower end 240*b*. External threads 242 are provided at upper end 240*a*, and counterbore 241 includes internal threads 243. Upper end 240*a* of connection member 240 is threaded into counterbore 222 of carrier rod 220 via mating threads 242, 228. A set screw is threaded radially through carrier rod 220 and into engagement with upper end 240*a* of connection member 240 disposed therein to prevent connection member 240 and carrier rod 220 from inadvertently unthreading.

Stabbing member 250 has a first or upper end 250*a*, a second or lower end 250*b* opposite end 250*a*, and a radially outer surface 251 extending axially between ends 250*a*, 250*b*. Outer surface 251 includes external threads 252 at upper end 250*a*, a cylindrical surface 253 extending axially from threads 252, an annular upward facing shoulder 254 at the lower end of cylindrical surface 253, and an enlarged tip or head 255 at lower end 250*b*. Upper end 250*a* is threaded into counterbore 241 of connection member via mating threads 252, 243. A set screw is threaded radially through connection member 240 and into engagement with upper end 250*a* of stabbing member 250 to prevent connection member 240 and stabbing member 250 from inadvertently unthreading.

Collet assembly 260 has a first or upper end 260*a* and a second or lower end 260*b*. In addition, collet assembly 260 includes an annular body 261 at upper end 260*a* and a plurality of circumferentially-spaced collets 262 extending axially from body 261 to lower end 260*b*. Body 261 includes a through bore or passage 263 through which stabbing member 250 coaxially extends. In particular, body 261 is slidingly mounted along cylindrical surface 253 and can move axially along surface 253 between lower end 240*a* of connection member 240 and shoulder 254. Each collet 262 extends from body 261 and includes a first or fixed end 262*a* secured to body 261 and a second or free end 262*b* distal body 261. Free ends 262*b* define the lower end 260*b* of collet assembly 260. Each free end 262*b* has a general downwardly pointing arrow shape including a tapered lower tip 263 and an upward facing shoulder 264 disposed on the radially outer surface of the corresponding collet 262. Free ends 262*b* and shoulders 254 thereon extend to an outer radius $R_{262}$.

As previously described, body 261 can move axially along surface 253 between lower end 240*a* of connection member 240 and shoulder 254. In particular, collet assembly 260 has a first position as shown in FIGS. 8 and 9A with body 261 engaging and axially adjacent connection member 240, and a second positon shown in FIG. 9C with body engaging shoulder 254 and axially spaced below connection member 240. When collet assembly 260 is in the first position, a space or gap is radially positioned between free ends 262*b* and stabbing member 250, and thus, free ends 262*b* can flex and move radially inward relative to stabbing member 250. However, when collet assembly 260 is in the second position, enlarged head 255 is disposed between free ends 262*b* and restricts and/or prevents free ends 262*b* from flexing radially inward relative to stabbing member 250. It should be appreciated that collets 262 function like springs that are biased to the relaxed state as shown in FIG. 8. In other words, collets 262 can be flexed radially inward with collet assembly 260 in the first position, but are biased radially outward to the relaxed state. In embodiments described herein, the radii R262 of free ends 262*b* with collets 262 in the relaxed state are preferably set such that free ends 262*b* can flex slightly radially inward to pass into the upper end of the plunger piston to be retrieved (e.g., sleeve 120, sleeve 130, etc.), and are the biased radially outwardly to the relaxed position to engage a fishing lip (e.g., shoulder 121*h*, 131*h*) within the plunger piston.

Referring now to FIGS. 9A-9C, tool 200 is shown retrieving plunger piston assembly 110. Starting with FIG. 9A, well 20 is shut in and tool 200 is dropped from the surface 28 down production tubing 35 and allowed to fall therethrough toward the stuck plunger piston assembly 110. During descent, sealing sleeve 230 is in the first or bypass position with surfaces 231*c*, 225 spaced apart, thereby allowing liquids 27 in production tubing 35 to bypass piston 230 via annulus 237 and ports 238. In addition, during descent, collet assembly 260 is in the first position with free ends 262*b* positioned axially above head 255 such that free ends 262*b* are free to flex radially inward relative to stabbing member 250. It should be appreciated that the projected cross-sectional areas of sealing sleeve 230 and collet assembly 260 relative to the remainder of tool 200 maintains sealing sleeve 230 is in the first or bypass position and collet assembly 260 in the first position during descent.

Referring now to FIG. 9B, when tool 200 reaches plunger piston assembly 110, the arrow shaped free ends 262*b* of collets engage upper end 120*a* and cam or flex radially inward, thereby allowing free ends 262*b* to pass through sleeve 120 and into sleeve 130. Frictional engagement of free ends 262*b* and sleeves 120, 130 decelerates and brings collet assembly 260 to a stop. Since collet assembly 260 is in the first position with body 261 axially abutting connection member 240, stabbing member 250, connection member 240, and carrier rod 220 are also brought to a stop. However, sealing sleeve 230 is slidably mounted to carrier rod 220, and thus, as carrier rod 220 decelerates and comes to a stop, sealing sleeve 230 slides downward along carrier rod 220 until spherical surface 225 is seated against surface 231*c*. With surfaces 225, 231*c* engaged, annulus 237 is closed off and fluids restricted and/or prevented from bypassing sleeve 230.

Moving now to FIG. 9C, once sufficient time is provided for tool 200 to reach plunger piston assembly 110, the well 20 is opened, thereby allowing formation fluids to migrate from formation 25 into wellbore 21 and production string 35. The pressure within production tubing 25 below assembly 110 and tool 200 continues to increase. However, since assembly 110 is stuck, the pressure differential across assembly 110 may be insufficient to dislodge it. Over time, fluids migrate around assembly 110 (e.g., between assembly 110 and production tubing 35), thereby generating a pressure differential across sleeve 230. Once the pressure differential across sleeve 230 is sufficient, sleeve 230, carrier rod 220, connection member 240, and stabbing member 250 are urged upward. With free ends 262*b* flexed radially inward, enlarged head 255 pushed upward on tips 263, thereby urging collet assembly 260 upward with stabbing member 250. As tool 200 moves upward relative to plunger piston assembly 110, free ends 262*b* continue to be biased radially outwardly against the inner surfaces of assembly 110. Once free ends 262*b* move axially into recess 131*c*, free ends 262*b* are urged radially outward, thereby bringing shoulders 264 into engagement with shoulder 131*h*. This prevents collet assembly 260 from moving upward in response to the pressure differential across sealing sleeve 230. However, the remainder of tool 200 can continue to move axially upward in response to the pressure differential across sealing sleeve 230, thereby moving enlarged head 255 between free ends 262*b* and axially impacting body 261 with shoulder 254. The impact of shoulder 254 against body 261 dislodges assembly 110, while the positioning of enlarged head 255 between free ends prevents free ends 262*b* from moving radially inward and out of engagement with shoulder 131*h*.

Once dislodged, the pressure differential across sealing sleeve 230 will allow tool 200 to lift assembly 110 to the surface 28. During ascent, enlarged head 255 remains positioned behind free ends 262*b* to prevent disengagement of shoulders 264, 131*h*, while snap ring 234 maintain sealing engagement of surfaces 231*c*, 225.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A plunger piston assembly for a plunger lift system used to remove fluids from a subterranean wellbore, the assembly comprising:

a sealing sleeve having a central axis, an upper end, a lower end, and a throughbore extending axially from the upper end of the sealing sleeve to the lower end of the sealing sleeve, wherein the throughbore of the sealing sleeve defines a receptacle extending axially from the lower end of the sealing sleeve;

an intermediate sleeve having a central axis, an upper end, a lower end, and a throughbore extending axially from the upper end of the intermediate sleeve to the lower end of the intermediate sleeve, wherein the throughbore of the intermediate sleeve defines a receptacle extending axially from the lower end of the intermediate sleeve;

wherein the upper end of the intermediate sleeve is configured to be removably seated in the receptacle of the seating sleeve;

a plug configured to be removably seated in the in the receptacle of the intermediate sleeve;

wherein the intermediate sleeve has a radially outer surface extending axially from the upper end of the intermediate sleeve to the lower end of the intermediate sleeve;

wherein the outer surface of the intermediate sleeve comprises a frustoconical surface extending axially from the upper end of the intermediate sleeve;

wherein the sealing sleeve has a radially inner surface defining the throughbore of the of the sealing sleeve, wherein the inner surface of the sealing sleeve comprises a frustoconical surface extending axially from the lower end of the sealing sleeve along the receptacle;

wherein the frustoconical surface of the intermediate sleeve is configured to mate and slidingly engage the frustoconical surface of the sealing sleeve.

2. The plunger piston of claim 1, wherein the frustoconical surface of the sealing sleeve is disposed at an angle $\alpha$ relative to the central axis of the sealing sleeve;

wherein the frustoconical surface of the intermediate sleeve is disposed at an angle $\theta$ relative to the central axis of the intermediate sleeve;

wherein angle $\theta$ is the same as angle $\alpha$.

3. The plunger piston of claim 2, wherein angle $\alpha$ and angle $\theta$ are each between 10° and 20°.

4. The plunger piston of claim 1, wherein the plug is a spherical ball;

wherein the receptacle of the intermediate sleeve comprises a hemispherical surface configured to mate and slidingly engage the spherical ball.

5. The plunger piston of claim 1, wherein the sealing sleeve has a length $L_1$ measured axially from the upper end of the sealing sleeve to the lower end of the sealing sleeve;

wherein the intermediate sleeve has a length $L_2$ measured axially from the upper end of the intermediate sleeve to the lower end of the intermediate sleeve;

wherein the length $L_1$ is less than the length $L_2$.

6. The plunger piston of claim 5, wherein the sealing sleeve has a radially outer surface extending axially from the upper end of the sealing sleeve to the lower end of the sealing sleeve, wherein the outer surface of the sealing sleeve comprises a cylindrical surface defining a maximum outer diameter $D_1$ of the sealing sleeve;

wherein the intermediate sleeve has a radially outer surface extending axially from the upper end of the intermediate sleeve to the lower end of the intermediate sleeve, wherein the outer surface of the intermediate sleeve comprises a cylindrical surface defining a maximum outer diameter $D_2$ of the intermediate sleeve;

wherein the maximum outer diameter $D_1$ of the sealing sleeve is greater than the maximum outer diameter $D_2$ of the intermediate sleeve.

7. The plunger piston of claim 6, wherein the sealing sleeve has a radially outer surface extending axially from the upper end of the sealing sleeve to the lower end of the sealing sleeve, wherein the outer surface of the sealing sleeve comprises a cylindrical surface defining a maximum outer diameter $D_1$ of the sealing sleeve;

wherein the intermediate sleeve has a radially outer surface extending axially from the upper end of the intermediate sleeve to the lower end of the intermediate sleeve, wherein the outer surface of the intermediate sleeve comprises a cylindrical surface defining a maximum outer diameter $D_2$ of the intermediate sleeve;

wherein a plurality of axially spaced annular grooves extend radially into the cylindrical surface of the sealing sleeve;

wherein a plurality of axially spaced annular grooves extend radially into the cylindrical surface of the intermediate sleeve.

8. A plunger lift system for removing liquids from a subterranean wellbore, the system comprising:

a production string extending through the wellbore;

a plunger piston assembly moveably disposed in the production string, wherein the plunger piston assembly comprises:

a sealing sleeve having an upper end, a lower end, and a throughbore extending axially from the upper end of the sealing sleeve to the lower end of the sealing sleeve;

an intermediate sleeve disposed below the sealing sleeve, wherein the intermediate sleeve has an upper end, a lower end, and a throughbore extending axially from the upper end of the intermediate sleeve to the lower end of the intermediate sleeve; and a plug disposed below the intermediate sleeve, wherein the plug is configured to be removably disposed in the throughbore of the intermediate sleeve;

wherein the plunger piston assembly has a divided arrangement with the sealing sleeve, the intermediate sleeve, and the plug spaced apart, and a nested arrangement with the sealing sleeve, the intermediate sleeve, and the plug removably coupled together;

wherein the plunger piston assembly is configured to descend at least partially through the production string in the divided arrangement and ascend in the production string in the nested arrangement.

9. The plunger lift system of claim 8, wherein the upper end of the intermediate sleeve is seated in a receptacle in the lower end of the sealing sleeve with the plunger piston assembly in the nested arrangement;

wherein the plug is seated in a receptacle in the lower end of the intermediate sleeve with the plunger piston assembly in the nested arrangement.

10. The plunger lift system of claim 9, wherein the receptacle of the sealing sleeve comprises a seating surface configured to mate and slidingly engage the stabbing member of the intermediate sleeve with the plunger piston assembly in the nested arrangement.

11. The plunger lift system of claim 10, wherein the plug is a spherical ball;

wherein the receptacle of the intermediate sleeve comprises a hemispherical surface configured to mate and slidingly engage the hemispherical surface.

12. The plunger lift system of claim 8, wherein the sealing sleeve has an outer cylindrical surface defining a maximum outer diameter $D_1$ of the sealing sleeve;

wherein the outer cylindrical surface of the sealing sleeve sealingly engages the production string.

13. The plunger lift system of claim 12, wherein the intermediate sleeve has an outer cylindrical surface defining a maximum outer diameter $D_2$ of the intermediate sleeve;

wherein the maximum outer diameter $D_2$ of the intermediate sleeve is less than the maximum outer diameter $D_1$ of the sealing sleeve.

14. The plunger lift system of claim 8, further comprising:

a lower bumper disposed in the production string;

a production tree coupled to an upper end of the production string;

a lubricator coupled to an upper end of the production tree, wherein the lubricator includes an upper bumper and a striking rod configured to eject the plug from the intermediate sleeve;

wherein the plunger piston assembly is configured to ascend to the lubricator in the nested arrangement and descend to the lower bumper in the divided arrangement.

15. The plunger lift system of claim 8, wherein the sealing sleeve has a length $L_1$ measured axially from the upper end of the sealing sleeve to the lower end of the sealing sleeve;

wherein the intermediate sleeve has a length $L_2$ measured axially from the upper end of the intermediate sleeve to the lower end of the intermediate sleeve;

wherein the length $L_1$ is less than the length $L_2$.

16. A method for removing accumulated liquids from a subterranean wellbore with a plunger piston assembly comprising a plug, a sealing sleeve, and an intermediate sleeve, the method comprising:

(a) dropping the plug of the plunger piston assembly down a production string and through accumulated liquids in the production string;

(b) dropping the sealing sleeve and the intermediate sleeve of the plunger piston assembly down the production string and through accumulated liquids in the production string after (a), wherein the intermediate sleeve is positioned between the plug and the sealing sleeve;

(c) releasably receiving the plug into a receptacle at a lower end of the intermediate sleeve after (b);

(d) releasably receiving an upper end of the intermediate sleeve into a receptacle at a lower end of the sealing sleeve after (b);

(e) pushing accumulated liquids in the production string disposed above the plunger piston assembly to the surface after (c) and (d).

17. The method of claim 16, wherein the sealing sleeve includes a throughbore and the intermediate sleeve includes a throughbore;

wherein (a) comprises passing the accumulated liquids in the production string between the plug and the production string;

wherein (b) comprises passing the accumulated liquids in the production string through the throughbore of the sealing sleeve;

wherein (b) comprises passing at least a portion of the accumulated liquids in the production string through the throughbore of the sealing sleeve.

18. The method of claim 17, wherein the sealing sleeve sealingly engages the production string during (b).

19. The method of claim 18, wherein the intermediate sleeve does not sealingly engages the production string during (b).

20. The method of claim 17, wherein the sealing sleeve includes a throughbore and the intermediate sleeve includes a throughbore;

wherein (e) comprises:

(e1) preventing the accumulate liquids in the production string above the plunger piston assembly from passing between the sealing sleeve and the production string;

(e2) preventing the accumulated liquids in the production string above the plunger piston assembly from passing through the throughbore of the sealing sleeve and the throughbore of the intermediate sleeve with the plug.

21. The method of claim 16, wherein the sealing sleeve has a length that is less than a length of the intermediate sleeve.

* * * * *